US010973298B2

(12) United States Patent
Kennedy et al.

(10) Patent No.: US 10,973,298 B2
(45) Date of Patent: Apr. 13, 2021

(54) DIGITALLY CONTROLLED HAIRDRYER

(71) Applicant: The Beachwaver Co., Libertyville, IL (US)

(72) Inventors: Sarah J. Kennedy, Green Oaks, IL (US); Erin A. Wall, Libertyville, IL (US); Luis Eduardo Alanis, Libertyville, IL (US); Manuel Besnier Lopez, Libertyville, IL (US)

(73) Assignee: The Beachwaver Co., Libertyville, IL (US)

( * ) Notice: Subject to any disclaimer, the term of this patent is extended or adjusted under 35 U.S.C. 154(b) by 231 days.

(21) Appl. No.: 16/128,606

(22) Filed: Sep. 12, 2018

(65) Prior Publication Data

US 2019/0075905 A1 Mar. 14, 2019

Related U.S. Application Data

(60) Provisional application No. 62/557,343, filed on Sep. 12, 2017.

(51) Int. Cl.
*A45D 20/12* (2006.01)
*F24H 3/04* (2006.01)

(52) U.S. Cl.
CPC ..... *A45D 20/124* (2013.01); *A45D 20/122* (2013.01); *F24H 3/0423* (2013.01); *A45D 2020/128* (2013.01); *A45D 2200/202* (2013.01)

(58) Field of Classification Search
CPC ..... A45D 20/124; A45D 2200/202; A45D 2020/128; A45D 20/122; A45D 20/10; A45D 20/50; A45D 20/12; A45D 20/00; F24H 3/0423
USPC ..... 34/86
See application file for complete search history.

(56) References Cited

U.S. PATENT DOCUMENTS 1,835,337 A * 12/1931 Rose ..... A45D 20/122 34/99
1,951,269 A * 3/1934 Boeckx ..... A45D 20/122 132/212
2,420,732 A * 5/1947 Bichsel ..... A45D 20/10 392/385
2,713,627 A * 7/1955 Kamataris ..... A45D 20/10 392/383
2,962,576 A * 11/1960 Russell ..... A45D 20/12 392/379

(Continued)

FOREIGN PATENT DOCUMENTS

WO 2010019512 2/2010

*Primary Examiner* — Edelmira Bosques
*Assistant Examiner* — Bao D Nguyen
(74) *Attorney, Agent, or Firm* — Botkin & Hall, LLP

(57) ABSTRACT

A digitally controlled hairdryer has removable attachments that are used to style hair. The hairdryer is powered with AC and DC power, with the DC power supply being separate from the main body. The removable attachments are powered and controlled by the hairdryer. The oscillating attachment has a motor that moves an oscillating portion to direct airflow from the outlet of the hairdryer. The diffuser attachment has a motor that is connected to a slider that moves along a central axis. The slider moves wire fingers between a grasped and relaxed position. The ends of the fingers are connected to a blocking membrane that directs airflow through an outlet aperture that is small in the grasped position and large in the relaxed position.

17 Claims, 21 Drawing Sheets

(56) References Cited

U.S. PATENT DOCUMENTS 3,797,752 A * 3/1974 Cercone ..... A45D 20/122 239/443
3,837,581 A * 9/1974 Orsoff ..... A45D 20/122 239/289
3,860,174 A * 1/1975 Cercone ..... A45D 20/122 239/135
3,943,329 A * 3/1976 Hlavac ..... A45D 20/122 392/379
3,981,314 A * 9/1976 Barradas ..... A45D 20/12 132/118
4,019,260 A * 4/1977 Levy ..... A45D 20/122 34/97
4,039,774 A * 8/1977 Kata ..... A45D 20/10 392/384
4,167,660 A * 9/1979 Liedtke ..... H01H 19/56 200/567
4,192,325 A * 3/1980 Liedtke ..... A45D 20/50 132/271
4,232,454 A * 11/1980 Springer ..... A45D 20/122 239/455
4,287,673 A * 9/1981 Wolter ..... A45D 20/122 239/524
4,328,818 A * 5/1982 Glucksman ..... A45D 20/50 132/271
4,391,047 A * 7/1983 Janssens ..... A45D 20/122 132/212
4,525,623 A * 6/1985 Da Silva ..... A45D 20/122 137/601.05
4,538,362 A * 9/1985 Andis ..... A45D 20/122 34/101
4,556,782 A * 12/1985 Fujishima ..... A45D 20/10 174/135
4,602,146 A * 7/1986 Barns ..... F24H 3/0423 34/96
4,721,121 A * 1/1988 Adams ..... A45D 20/50 132/212
4,827,105 A * 5/1989 Brown, Jr. ..... A45D 20/12 219/222
5,157,757 A * 10/1992 McDougall ..... A45D 20/122 239/455
5,275,339 A * 1/1994 Andis ..... A45D 20/122 239/443
5,394,620 A * 3/1995 Chimera ..... A45D 20/10 34/97
5,488,783 A * 2/1996 Parkinson ..... A45D 20/122 34/283
5,626,123 A * 5/1997 Johnson ..... F41B 11/54 124/63
5,628,123 A * 5/1997 Chan ..... A45D 20/12 34/90
5,715,847 A * 2/1998 Rolf ..... A45D 20/122 132/129
5,765,292 A * 6/1998 Chan ..... A45D 20/122 132/212
5,839,451 A * 11/1998 Dorber ..... A45D 20/12 132/271
5,841,943 A * 11/1998 Nosenchuck ..... A45D 20/10 392/385
5,845,656 A * 12/1998 Assmann ..... A45D 20/122 132/271
5,894,849 A * 4/1999 Ehlhardt ..... A45D 20/50 132/271
6,003,239 A * 12/1999 Liebenthal ..... A45D 20/12 34/97
6,053,181 A * 4/2000 Ehlhardt ..... A45D 20/50 132/269
6,067,724 A * 5/2000 Depoyian ..... A45D 20/12 34/97
6,199,295 B1 * 3/2001 Smal ..... A45D 20/122 34/98
6,222,988 B1 * 4/2001 Behrendt ..... A45D 20/12 219/541
6,532,968 B1 * 3/2003 Hafemann ..... A45D 20/12 132/271
6,966,125 B2 11/2005 Rago et al.
7,047,660 B2 5/2006 Leventhal
7,586,066 B2 * 9/2009 Bell ..... A45D 1/02 132/118
8,082,679 B1 * 12/2011 Arnim ..... A45D 20/10 34/97
8,490,633 B1 * 7/2013 Kennedy ..... A45D 20/00 132/228
8,732,976 B2 5/2014 Han et al.
9,072,358 B2 7/2015 Han et al.
9,237,789 B2 1/2016 Prehodka
9,707,580 B1 * 7/2017 Mancl ..... B05B 7/2491
10,702,037 B2 * 7/2020 Boateng ..... A45D 20/122
10,849,400 B2 * 12/2020 Weatherly ..... A45D 20/122
2003/0079366 A1 * 5/2003 Chang ..... A45D 20/122 34/96
2004/0047620 A1 * 3/2004 Ruben ..... A45D 20/122 392/385
2005/0072019 A1 * 4/2005 Rago ..... A45D 20/12 34/96
2006/0201016 A1 * 9/2006 Nakagawa ..... A45D 20/12 34/96
2008/0116753 A1 * 5/2008 Carlucci ..... A45D 20/10 310/50
2008/0223394 A1 * 9/2008 Maddocks ..... A45D 1/06 132/232
2008/0271337 A1 * 11/2008 Chan ..... A45D 20/122 34/98
2010/0101598 A1 * 4/2010 Ng ..... A45D 2/001 132/223
2011/0197466 A1 * 8/2011 Shami ..... A45D 20/12 34/283
2011/0209721 A1 * 9/2011 Yahnker ..... A45D 20/12 132/271
2011/0277335 A1 * 11/2011 Prehodka ..... A45D 20/12 34/96
2013/0239427 A1 * 9/2013 Quessard ..... A45D 20/00 34/98
2013/0291394 A1 * 11/2013 Shami ..... A45D 20/10 34/88
2015/0335128 A1 * 11/2015 Larkin ..... A45D 20/10 34/553
2016/0262520 A1 * 9/2016 Depoyian ..... A45D 20/50
2016/0324292 A1 * 11/2016 Depoyian ..... A45D 20/50
2016/0367003 A1 * 12/2016 Stephens ..... A45D 20/122
2016/0367004 A1 * 12/2016 Stephens ..... A45D 20/122
2016/0367005 A1 * 12/2016 Stephens ..... A45D 20/122
2016/0367006 A1 * 12/2016 Stephens ..... A45D 20/122
2016/0367007 A1 * 12/2016 Stephens ..... A45D 20/122
2016/0367008 A1 * 12/2016 Stephens ..... A45D 20/122
2017/0095050 A1 * 4/2017 Dineen ..... A45D 20/12
2018/0042356 A1 * 2/2018 Pavis ..... A45D 40/00

* cited by examiner

DIGITALLY CONTROLLED HAIRDRYER

CROSS REFERENCE TO RELATED APPLICATIONS

This application claims the benefit of U.S. Provisional Application No. 62/557,343, filed Sep. 12, 2017, the disclosures of which are hereby incorporated by reference.

BACKGROUND OF THE INVENTION

This present disclosure relates to electric hairdryers. Hairdryers have been around for many years, necessitated by long hair and the user's desire to style and/or dry it. Commonly available hair dryers are electric and plug into standard household current. Hair dryers have a heater of some sort and a device to move air through the heater, such as a fan. Most hairdryers have simple controls, such as switches, to turn the heater and fan on or off. Some hair dryers have speed controls, such as sliding switches or levers that allow the user to coarsely control the heater and fan. These dryers use brushed electric motors due to their size, weight, and cost. Recently, brushless motors have made an entry into hairstyling appliances, such as hairdryers. Hairdryers that utilize brushless motors can be very heavy, as the power supply required to run a brushless motor and other ancillary devices adds weight. A hairdresser needs a device that is easy to handle and lightweight. An improved hairdryer is needed.

SUMMARY OF THE INVENTION

The present disclosure describes a digitally controlled hair dryer with powered attachments. The powered attachments are controlled by the hair dryer. The hair dryer uses a high-performance brushless motor that moves air across a heating element. The hairdryer is powered by AC (alternating current) and DC (direct current). The heating element is AC-powered and the brushless motor is powered by DC. The DC power source is located outside of the hairdryer body to reduce weight and fatigue. The hairdryer body has controls for airspeed, temperature, and any powered accessories (hereinafter described). The powered accessories are controlled by an option button on the hairdryer. The hair dryer has an annular air inlet that encircles an inlet chamber The oscillating nozzle has a motor that moves a nozzle back and forth. The oscillating nozzle attaches to the hair dryer to direct airflow from the outlet of the hair dryer through the nozzle. When the operator presses the option button on the hair dryer, the hair dryer provides power to the motor inside the oscillating nozzle. The motor rotates an eccentric cam with a pin around a motor axis, the pin slides in a slot and moves the nozzle back and forth about an oscillating axis. As the nozzle moves back and forth, it directs the air from the hairdryer into a back and forth motion that simulates the same motion as a hairstylist would use to dry hair without overheating it.

The curling diffuser has a motor that moves the diffuser between a relaxed and grasping position. The curling diffuser is used to bunch up and dry a section of hair to give it volume and reduce frizz. The relaxed position corresponds to a large opening and the grasping position has a constricted outlet with an outer surface that raises up to "bunch" the hair. The constriction and bunching occur simultaneously. The diffuser attaches to the hair dryer to direct airflow from the outlet of the hair dryer through a baffle that redirects the air through apertures that face the central axis. The curling diffuser has a motor that moves a slider along a central axis. The motor moves the slider between an extended position and a retracted position. The slider directs fingers between a relaxed and a grasped position. An air-blocking membrane and a mesh are located at the outlet of the curling diffuser, with the mesh allowing airflow and the membrane blocking air. When the slider moves to the extended position, the fingers move to the grasped position that constricts the outlet opening.

DESCRIPTION OF THE PREFERRED EMBODIMENT

Figure 1:
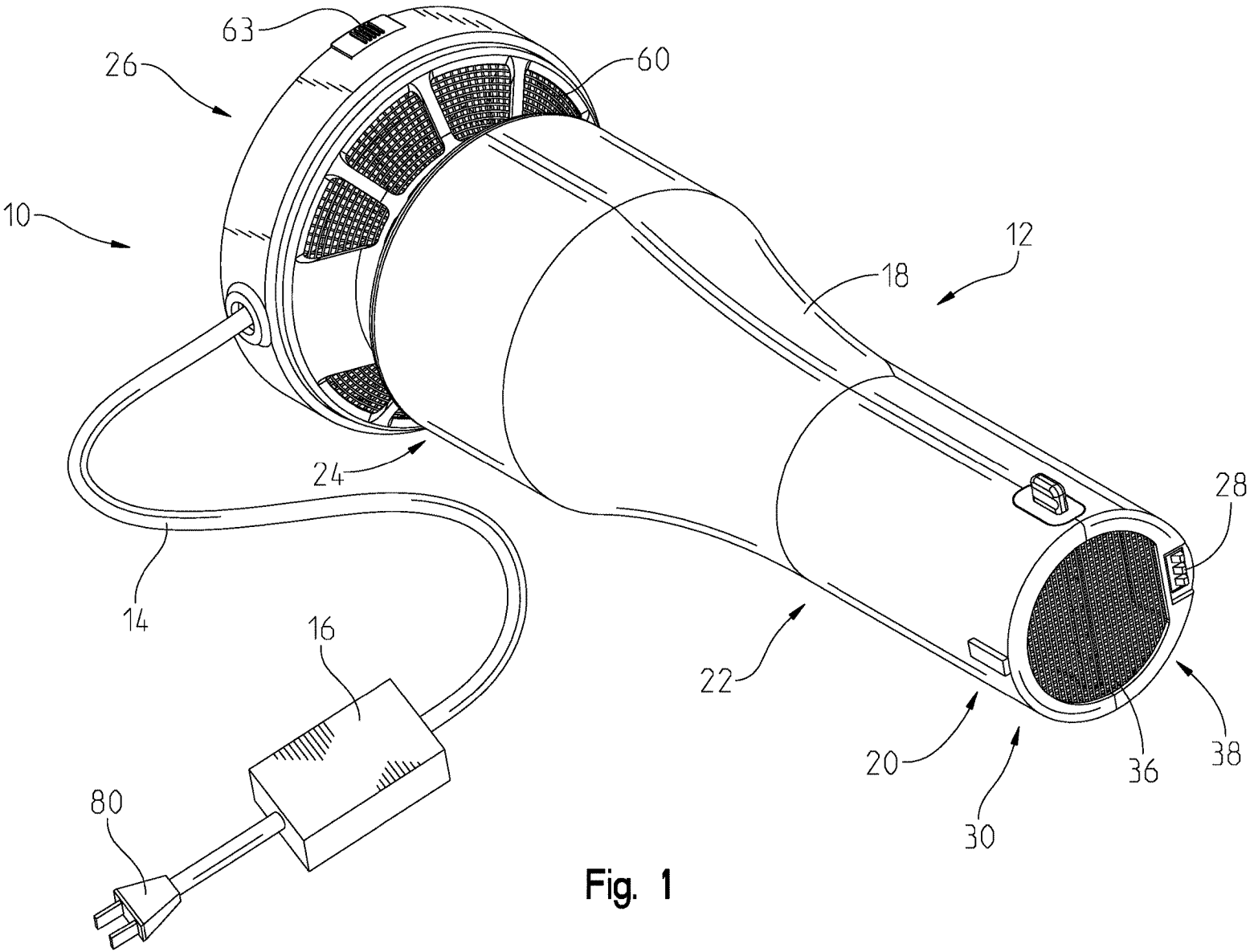
FIG. 1 is a front isometric view of the hairdryer.
Figure 2:
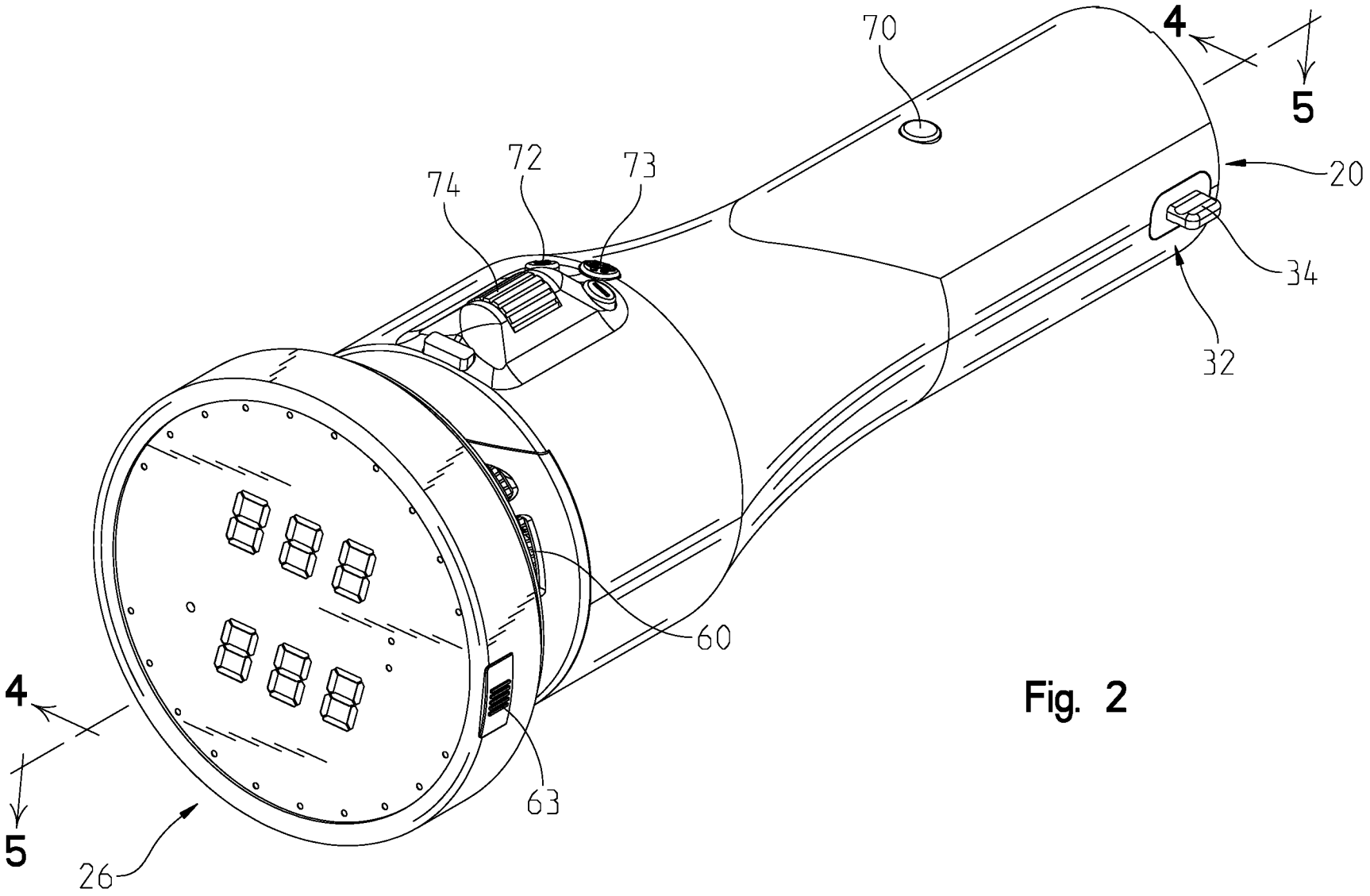
FIG. 2 is a rear isometric view of the hairdryer.
Figure 3:
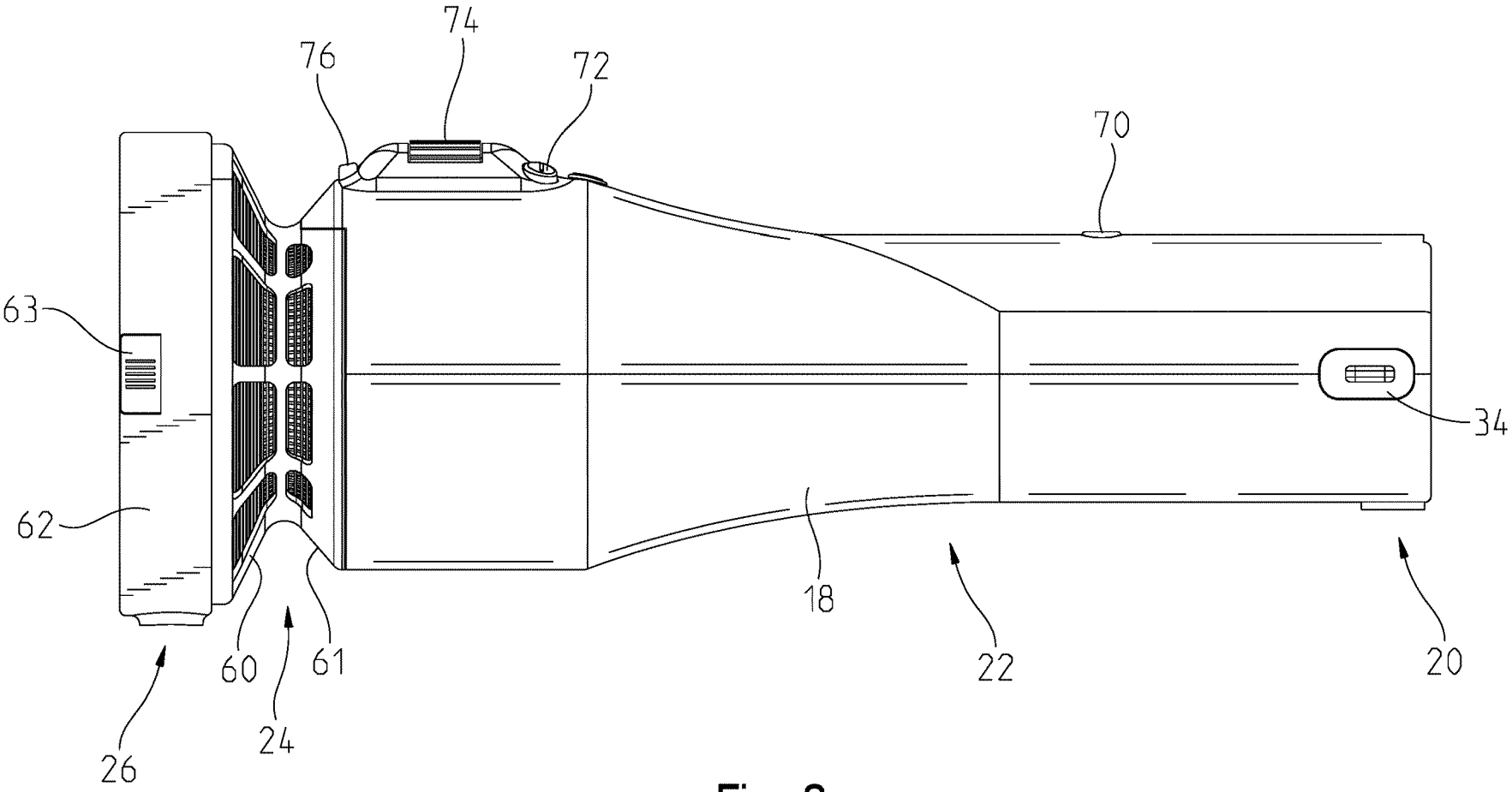
FIG. 3 is a side view of the hairdryer.
Figure 4:
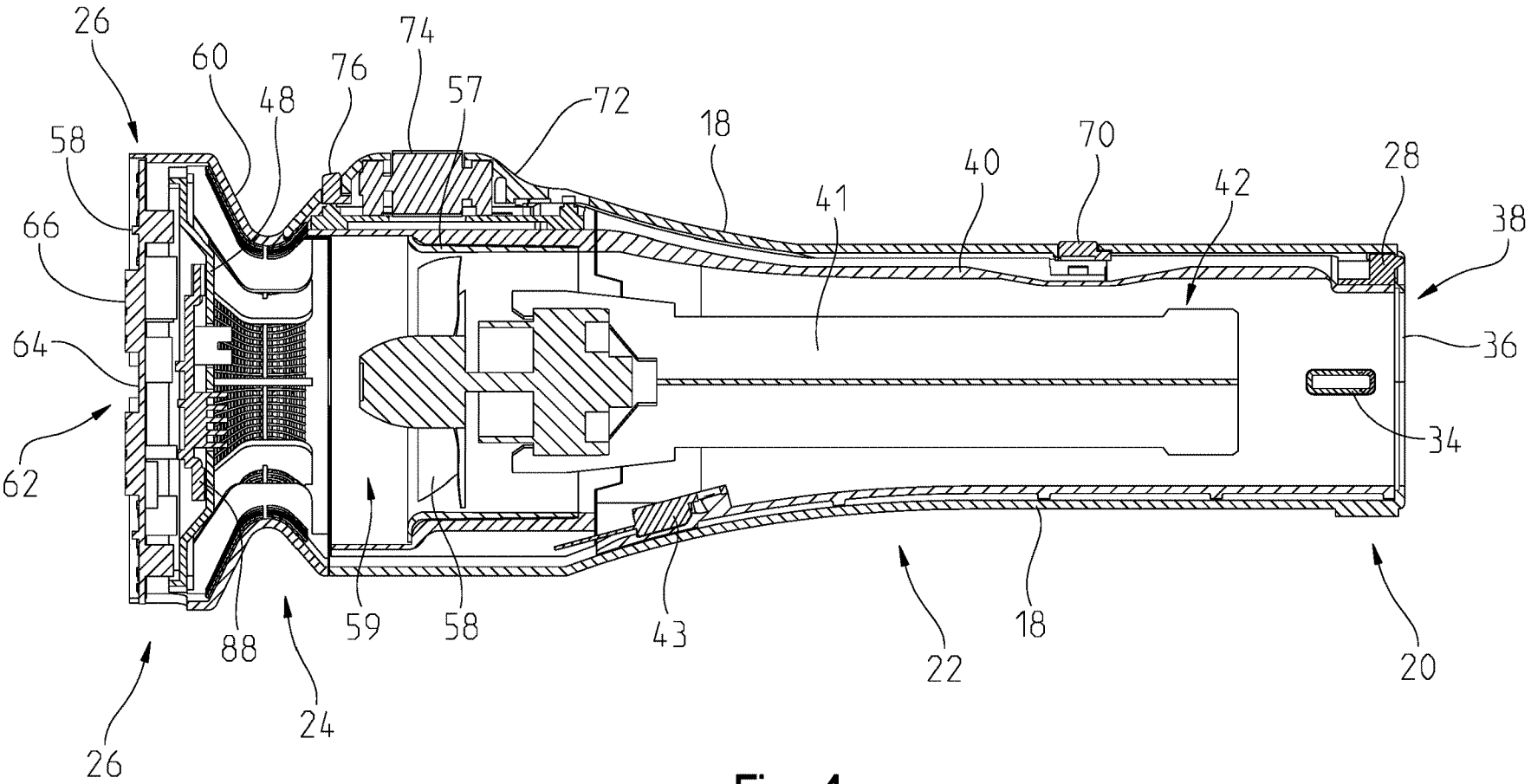
FIG. 4 is a side section view 4-4 of the hairdryer in FIG. 2.
Figure 5:
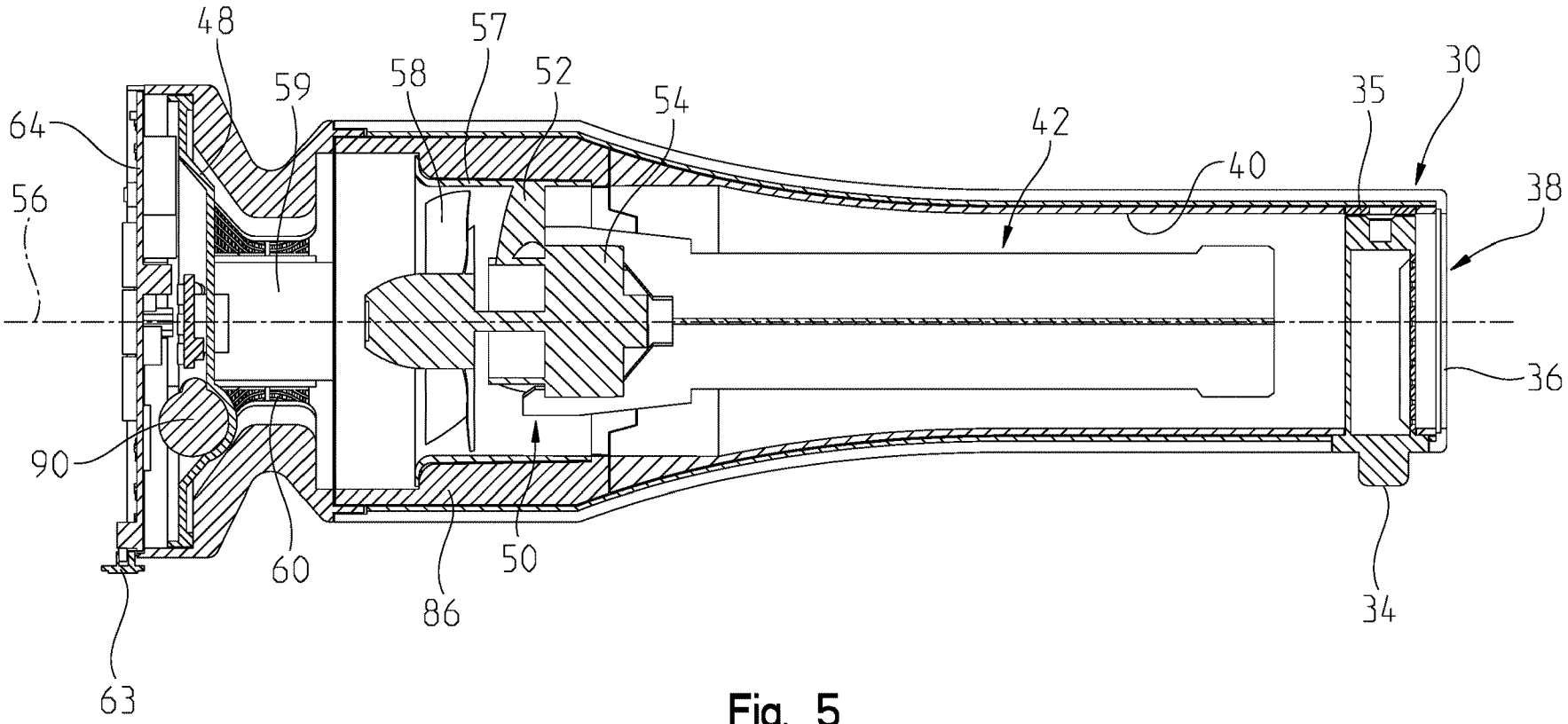
FIG. 5 is a top section view 5-5 of the hairdryer in FIG. 2.
Figure 6:
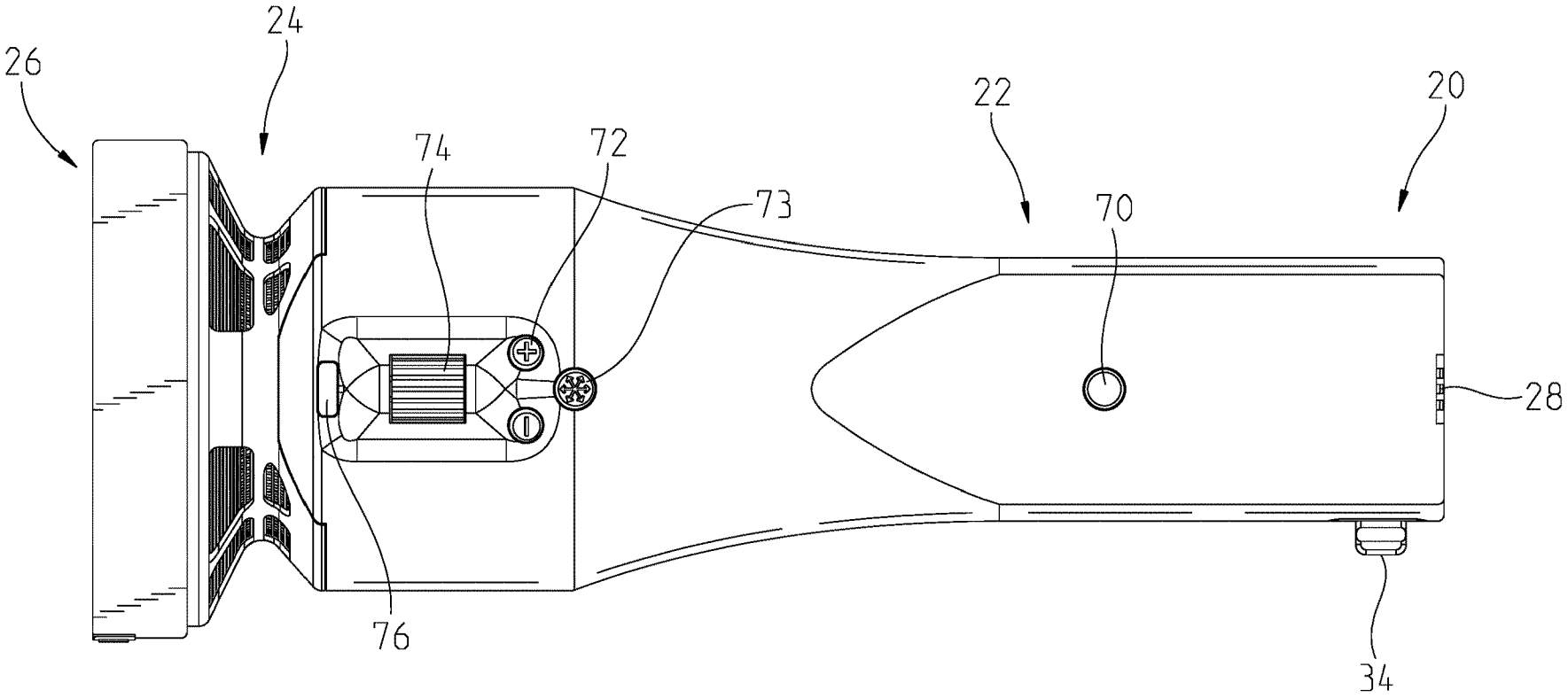
FIG. 6 is a top view of the hairdryer.
Figure 8:
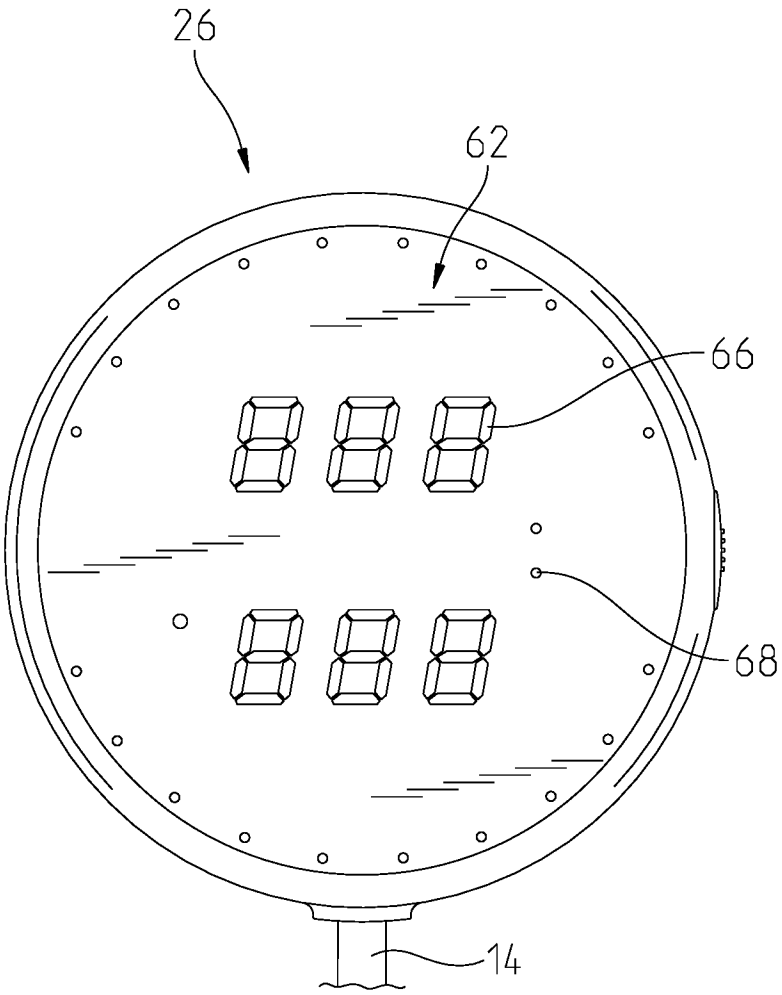
FIG. 8 is a rear view of the hairdryer.
Figure 7:
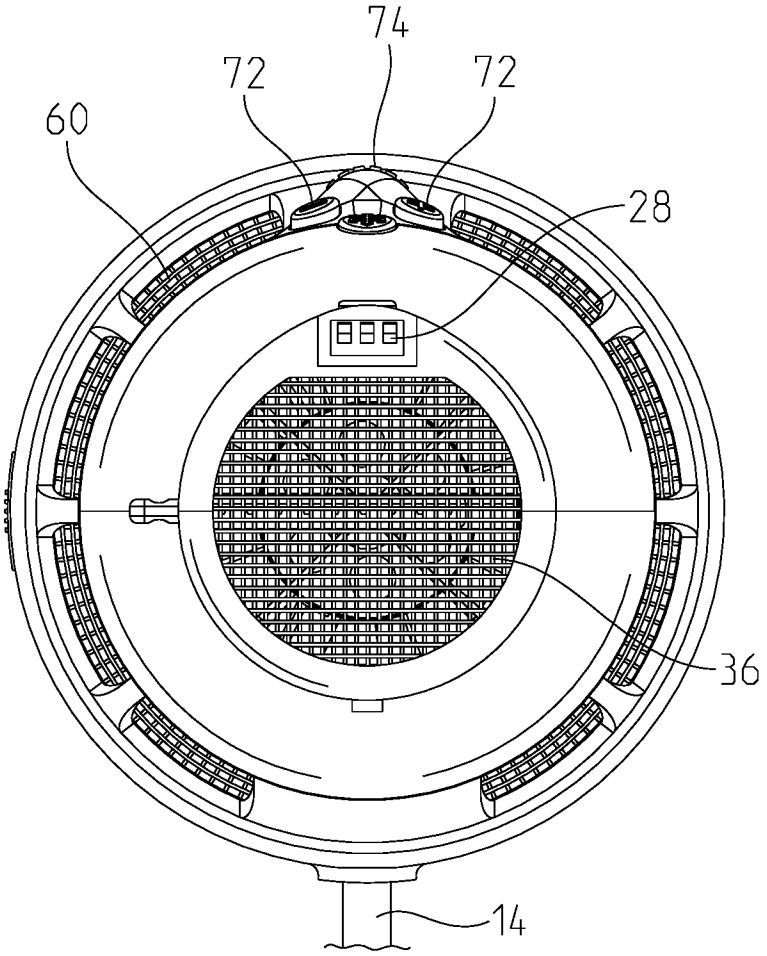
FIG. 7 is a front view of the hairdryer.
Figure 9:
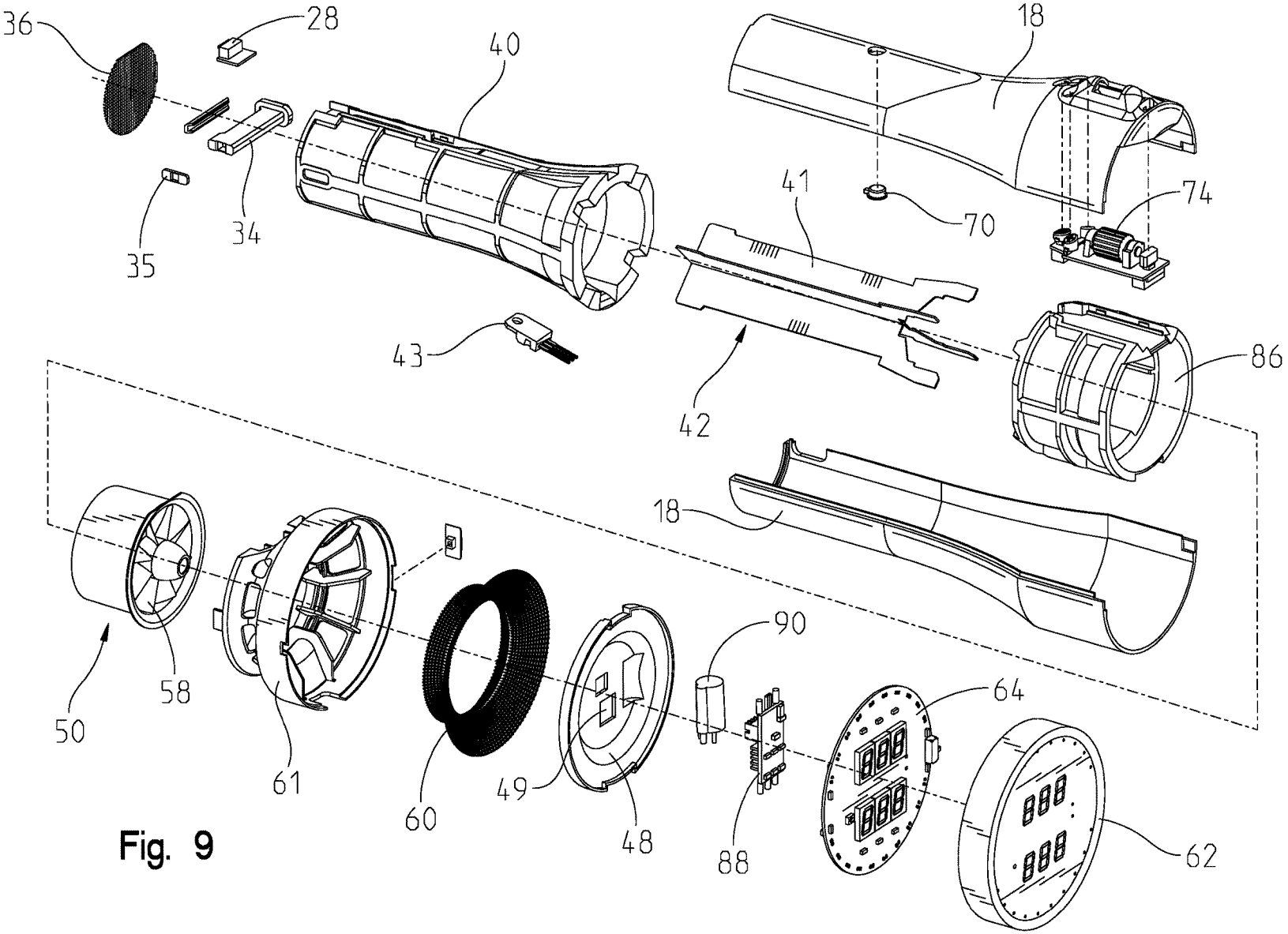
FIG. 9 is a rear isometric exploded view of the hairdryer.
Figure 10:
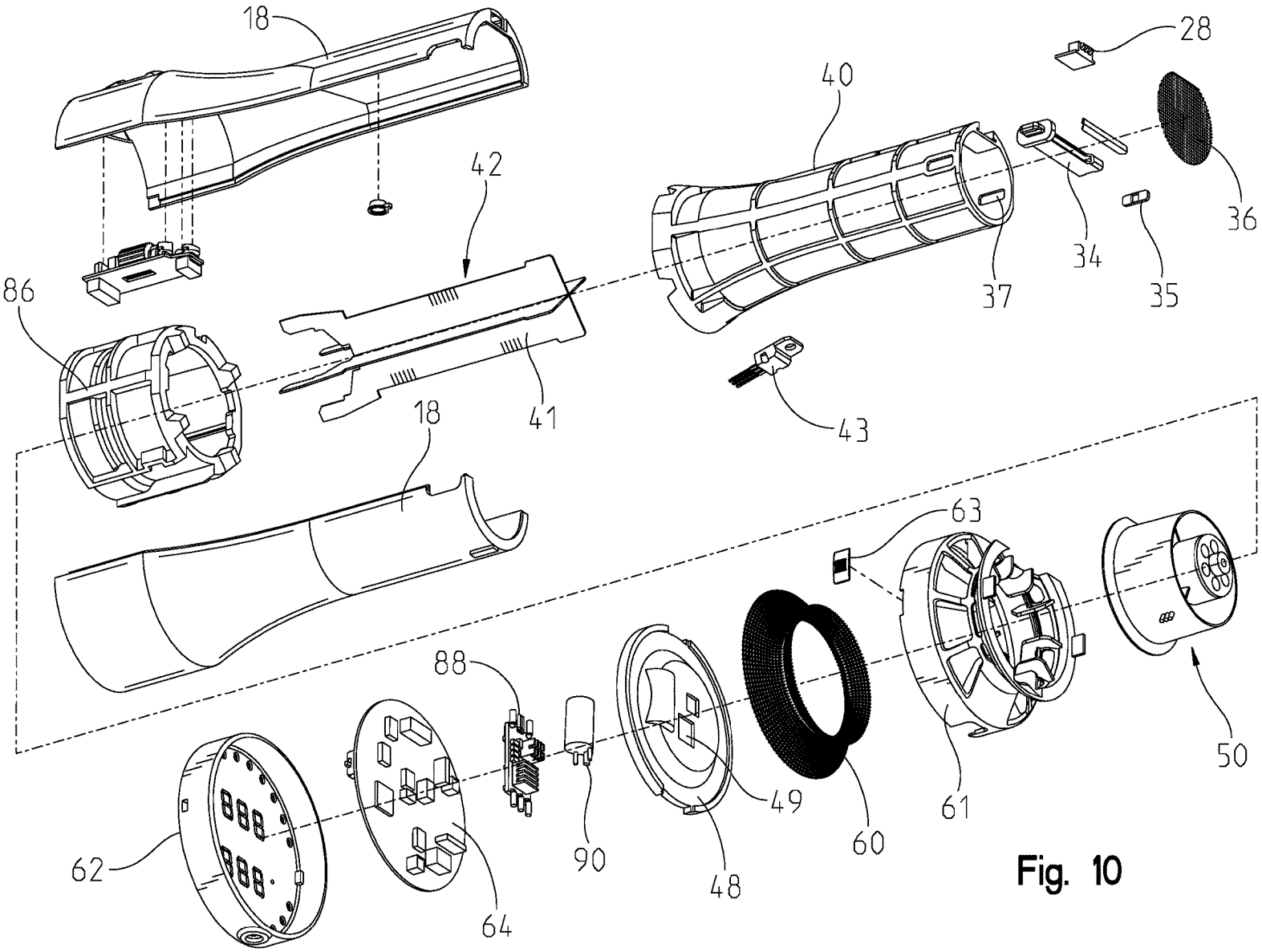
FIG. 10 is a front isometric exploded view of the hairdryer.
Figure 11:
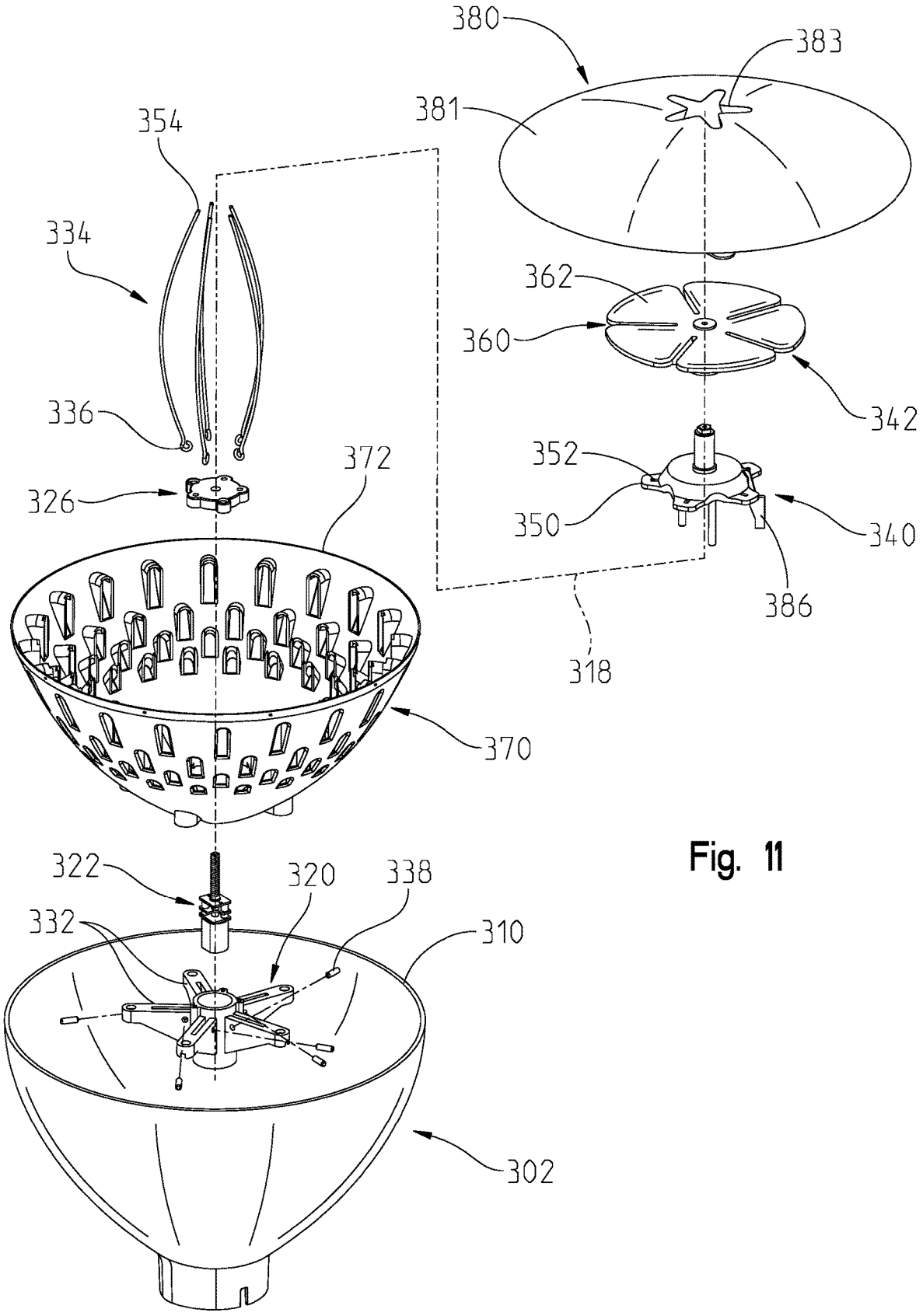
FIG. 11 is an isometric exploded view of a diffuser attachment.

A hair dryer 10 that is used for drying and styling hair is shown in FIGS. 1-10. As shown in FIG. 1, the hair dryer 10 has a main body 12, a power source 16, and a cord 14 that connects the power source 16 to the main body 12. The main body 12 has an outer shell 18 that is decorative and protects internal components. The outer shell 18 is made from lightweight materials, such as plastic. The main body 12 is separated into several portions: the outlet portion 20, the center portion 22, the inlet portion 24, and the control portion 26.

The outlet portion 20 is where the air exits the main body 12. The outlet portion 20 begins near the terminal end of the main body 12 and ends at the terminal end. The outlet portion 20 has an attachment area 30, where external devices, such as nozzles 100, diffusers 300, combs, or other hairdryer accessories can be attached. The outlet portion 20 further contains a pod receiver 32, where scent pods 34 can be attached. The scent pods 34 may contain perfumes, essential oils, hair nourishing compounds, or other cosmetic or therapeutic materials. The scent pods 34 are retained in the main body 12 through a magnet 35, but other methods are contemplated, such as a friction fit, clip, or snap feature. The outlet 38 contains a screen or mesh 36 to prevent foreign objects from being inserted into the outlet 38. Adjacent the outlet 38 is an accessory connector 28 that can provide electrical power and signals to a removable accessory, such as the oscillating nozzle 100 or the curling diffuser 300.

The center portion 22 has an inner structure 40 that insulates the outer shell 18 from heat generated by the internal heating element 42. The inner structure 40 is made from a heat-resistant material, such as an engineered resin or lightweight metal. The inner structure 40 provides an insulating barrier between heat-generating components, such as the heating element 42, electronic components, or brushless motor 50. The heating element 42 is a resistive wire wrapped around a mica structure 41, a design that is well-known in the art. Power is supplied to the heating element 42 through a digital control device, such as the triac 43, shown in FIG. 4. The triac 43 is mounted in the air flow path upstream of the heating element 42 to provide cooling with forced air. It is contemplated that the triac 43 is incorporated into the control portion 26. The center portion 22 further includes a brushless motor 50. The brushless motor 50 is a module with a stator 52 and a rotor 54. The stator 52 is affixed to the inner structure 40 and the rotor 54 rotates with respect to the stator 52 about a central axis 56. The rotor 54 is constrained axially and radially by the stator 52, inner structure 40, or both. The brushless motor 50 operates by using coils in the stator 52 to generate a dynamic magnetic field adjacent the rotor 54. This causes the rotor 54 to rotate without physically contacting or requiring an electrical connection to the rotor. Brushless motors 50 have a long life, commonly limited only by the life of the bearings. Affixed to the rotor 54 is an impeller 58 which moves air when it is rotated. The impeller 58 has blades and functions as a fan or blower when rotated. The impeller 58 has an outer diameter 57 that is defined by the tips of the blades that comprise the impeller 58. The inlet portion 24 further includes annular inlet ports 60 in an inlet housing 61 for a fluid path to an inlet chamber 59. The inlet chamber 59 is adjacent and in line with the impeller 58. The inlet chamber 59 is coaxial with the axis 56 of the rotor 54. The annular inlet ports 60 are annularly located around the inlet portion and bend radially inwardly which can be seen in FIG. 6. The inlet portion 24 has an hourglass shape that locates portions of the annular inlet ports 60 radially inward of the outer diameter 57 of the impeller 58. When the impeller 58 rotates, air is drawn in through the annular inlet ports 60, into the inlet chamber 59, then through the impeller 58, heating element 42, through the outlet portion 20, and through the outlet 38. In other words, air is drawn in circumferentially around the inlet portion 24. Additionally, air is drawn into the impeller 58 and through the hair dryer 10 in a coaxial fashion due to the hourglass shape of the inlet portion 24 that locates portions of the annular inlet ports 60 radially inward of the outer diameter 57 of the impeller 58. In this manner air flows in a straight-line flow path from the inlet ports 60, through the impeller 58 and out of the outlet 38. This laminar flow pattern results in an extremely efficient flow path that allows the use of less power and requires a smaller and lighter motor to move air through the hair dryer 10 than would otherwise be possible with a non-straight-line flow path. The stator 52 is located in the inner structure 40 by a resilient dampener 86. The dampener 86 surrounds the brushless motor 50 and absorbs any vibration created by the rotation of the rotor 54 and impeller 58. A motor controller 88 is electrically connected to the brushless motor 50. The magnet 35 is retained in a pocket 37 located in the inner structure 40.

Adjacent the annular inlet port 60 is the control portion 26. The control portion 26 is bounded by a duct plate 48 that faces the inlet chamber 59. The duct plate 48 serves as a rearward boundary of the inlet chamber 59. The duct plate 48 may have an aperture 49 or apertures where any heat producing components in the control portion 26 can protrude through into the inlet chamber 59 to receive fresh air that enters the annular inlet ports 60. The embodiment described herein uses apertures that are used for heat sinks or heat-generating components. The duct plate 48, even with the apertures 49, does not allow airflow to pass through it. The annular inlet ports 60 provide the fresh air for the motor 50 and heating element. The control portion 26 houses a user interface 62, power switch 63, a main control circuit board 64, and electrical connections to the heater 42 and brushless motor 50. The user interface 62 has a display 66 to notify the user the status of the hair dryer 10 and provide feedback on settings. It is contemplated that the motor controller 88 is integrated into the main control circuit board 64. Input buttons 68 may also be located on the user interface 62. Other commonly used inputs are located on the center portion 22, such as a first action button 70, temperature controls 72, a user-defined scroll wheel 74, and a second action button 76. The action buttons can be user-defined to temporarily disable heat, control speed, adjust temperature, or utilize commonly used features a stylist would need to quickly control the hair dryer 10 without using the user interface 62. A cool blast button 73 is located adjacent the temperature controls 72. The cool blast button 73 temporarily disables the heater to provide cool air instead of heated air. The cool blast button 73 may be momentary or push on/push off.

The power source 16 has a plug 80 that plugs into standard household alternating current (AC), such as 120V or 240V. Brushless motors, unlike brushed or induction motors, cannot be rotated by providing a constant source of electricity to the coils; the brushless motor 50 requires a specific control circuit to sequence power to the individual coils. This is commonly provided by a direct current (DC) power supply, which is located in the power source 16. Heating elements are frequently powered with AC. The power source 16 provides AC and DC to the main body 12 through a multi-conductor cord 14.

Controlling the hairdryer 10 is accomplished through the user interface 62, buttons 70, 72, 76, and scroll wheel 74. For example, the scroll wheel 74 can be used to precisely control the speed of the brushless motor 50, and therefore, the air speed. The temperature buttons 72 can be used to precisely control the amount of power applied to the heater 42, and therefore, the temperature of the air. The action buttons 70, 76 can be used to control accessories, such as the oscillating nozzle 100 or curling diffuser 300. A temperature sensor (not shown) may be used in the airflow path to allow closed-loop control of the air temperature. Other accessories or attachments are contemplated.

An optional ion generator 90 helps to reduce static electricity, improve drying time, reduce frizz, and help hair to lay flat. The ion generator 90 may be enabled, disabled, or configured through the control portion 26. The ion generator 90 is powered by the main control circuit board 64 and has a high voltage electrode that is located in the air stream.

Figure 20:
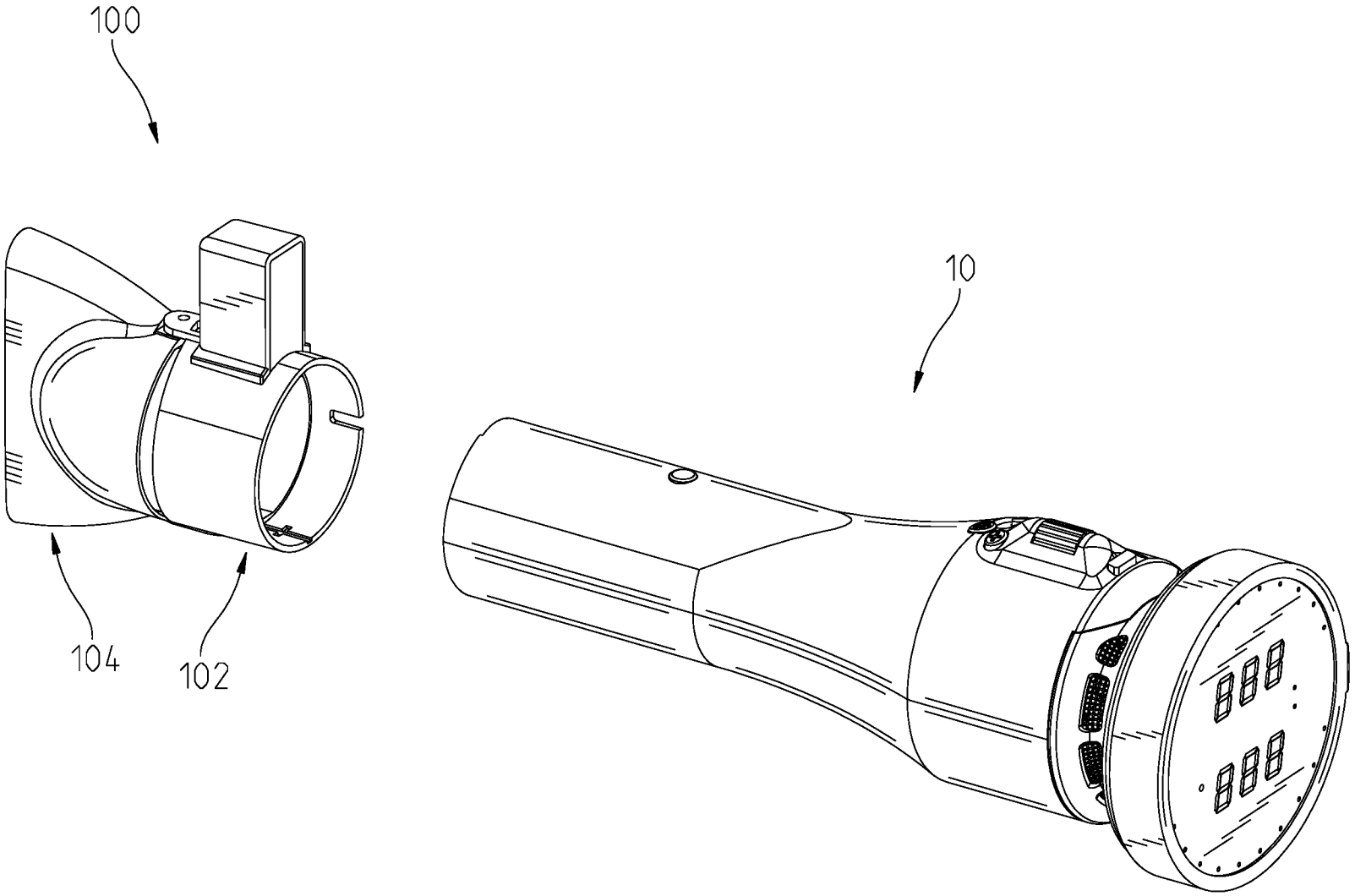
FIG. 20 is another isometric view of a oscillating nozzle as being attached to the hairdryer in FIG. 1.
Figure 21:
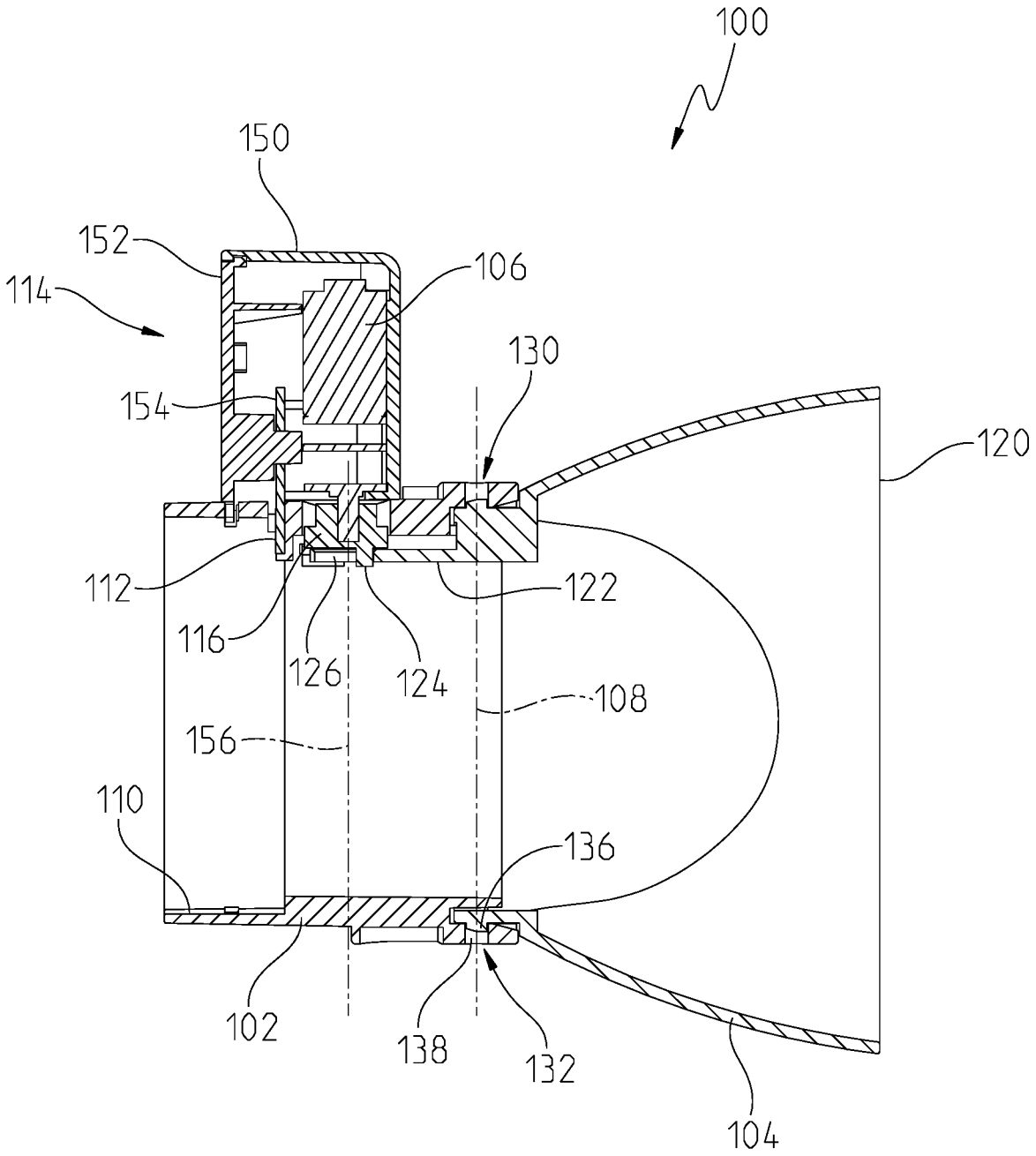
FIG. 21 is a side section view 21-21 of the oscillating nozzle in FIG. 19.
Figure 22:
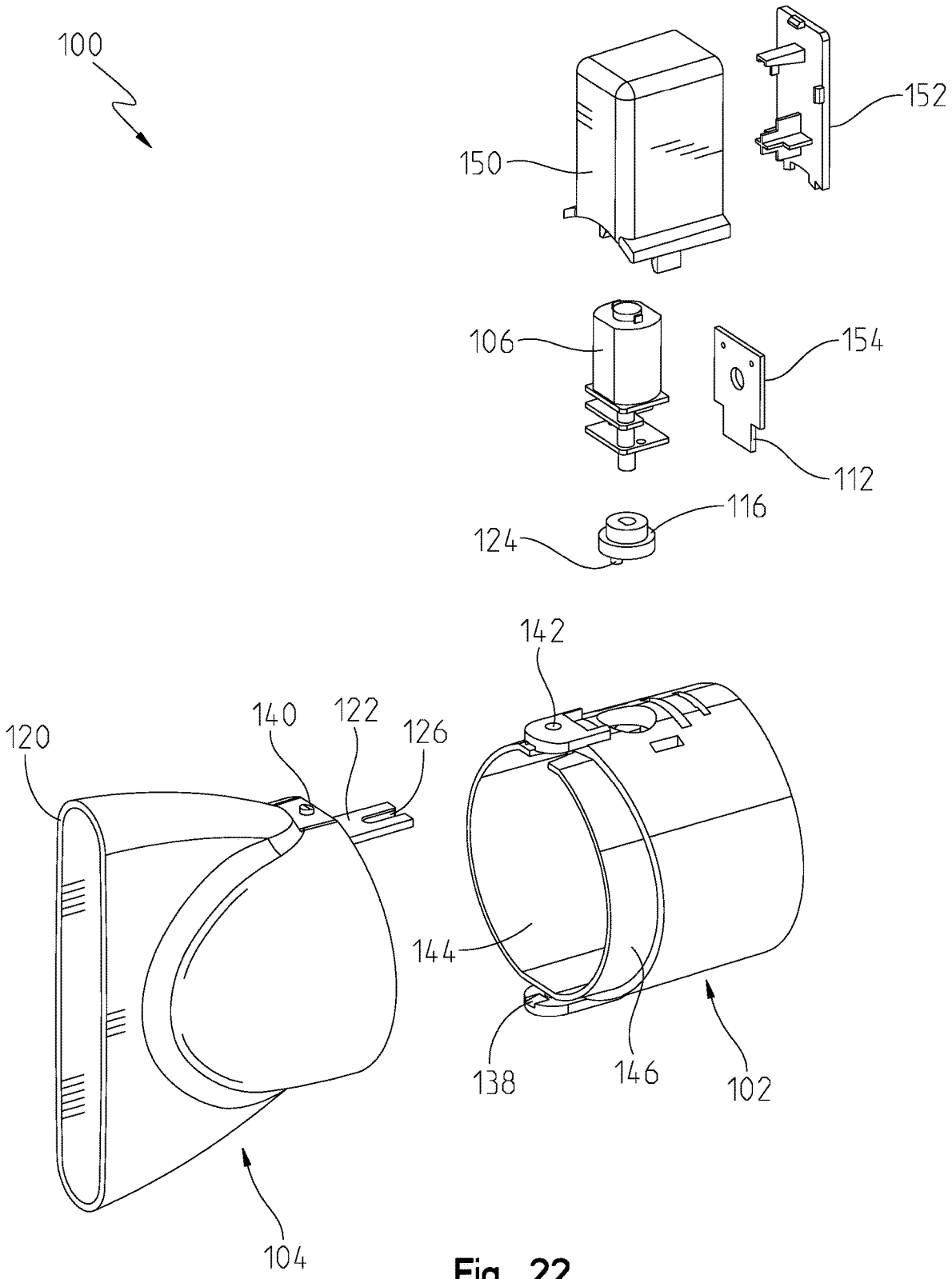
FIG. 22 is an exploded isometric view of the oscillating nozzle.

The oscillating nozzle 100, shown in FIGS. 19-22, is adapted to connect mechanically and electrically to the hairdryer 10, particularly the outlet portion 20. As shown in FIG. 20, the nozzle 100 has an attachment portion 102 and an oscillating portion 104. The attachment portion 102 has a sleeve portion 110 that fits over the outlet portion 20 and an electrical connector 112. The sleeve portion 100 may connect to the outlet portion 20 through a friction or interference fit or attach through a releasable latch. Further, it could connect using magnets. The electrical connector 112 mates with accessory connector 28 to provide a path for electrical current and signals from the control portion 26 to a motor 106. The motor 106 moves the oscillating portion 104 about an oscillation axis 108. The motor 106, as shown in FIG. 21, has a fixed portion 114 that is affixed to the attachment portion 102 and an eccentric cam 116 where it mates to the oscillating portion 104 at a follower fork 122 to move it back and forth. The eccentric cam 116 has a post 124 that protrudes therefrom that rides in the notch 126. As the eccentric cam 116 rotates, the post 124 moves the follower fork side to side, causing the oscillating portion 104 to rotate back and forth about the oscillation axis 108. Snap-fit joints 130, 132 are used to connect the oscillating portion 104 to the attachment portion 102 and form the oscillation axis 108. Snap-fit joint 130 is formed by a pin 136 on the oscillating portion 104 and a complementary pin aperture 138 on the attachment portion 102. Snap-fit joint 132 is formed by a pin 140 on the oscillating portion 104 and a complementary pin aperture 142 on the attachment portion 102. The attachment portion 102 has arcuate overhanging flow-directing walls 144, 146 that extend into the oscillating portion 104. The flow-directing walls reduce undesirable air leakage between the attachment portion 102 and oscillating portion 104. The motor 106 resides inside a housing 150 with a cover 152. The housing 150 and cover 152 retain the motor 106 and hold a circuit board 154 that has the electrical connector 112. The housing 150 and cover 152 snap together and into the attachment portion 102 to secure its components.

The attachment portion 102 has a fluid path through to the oscillating portion 104 so that air that is exiting the outlet 38 can travel unimpaired. The oscillating portion 104, where it is attached to the attachment portion 102, is circular and then gradually changes shape to an oval at the nozzle end 120. The oval shape changes the cylindrical air flow from the hairdryer 10 into more of a fan shape with a wider flow in one direction and narrower in the other. The motor 106 is shown as being powered and controlled by the action button 70, but other controls are contemplated.

As assembled to the hairdryer 10, the oscillating nozzle 100 aligns with the central axis 56. The eccentric cam 116 rotates about a motor axis 156 that is parallel to the oscillation axis 108. As shown, the central axis 56 intersects the oscillation axis 108 and motor axis 156.

A curling diffuser 300 is shown in FIGS. 11-18. The curling diffuser 300 is designed to work with and be powered by the hairdryer 10. The curling diffuser 300 connects to the outlet portion 20, where the accessory connector 28 makes an electrical connection. The electrical connection allows the hairdryer 10 to control movement of the diffuser 300. The diffuser 300 is used when the user desires to dry their hair without creating frizzy or flyaway hair. The hair is bunched up and heated to dry with the airflow diffused and slowed after being directed through an array of apertures.

Figure 13:
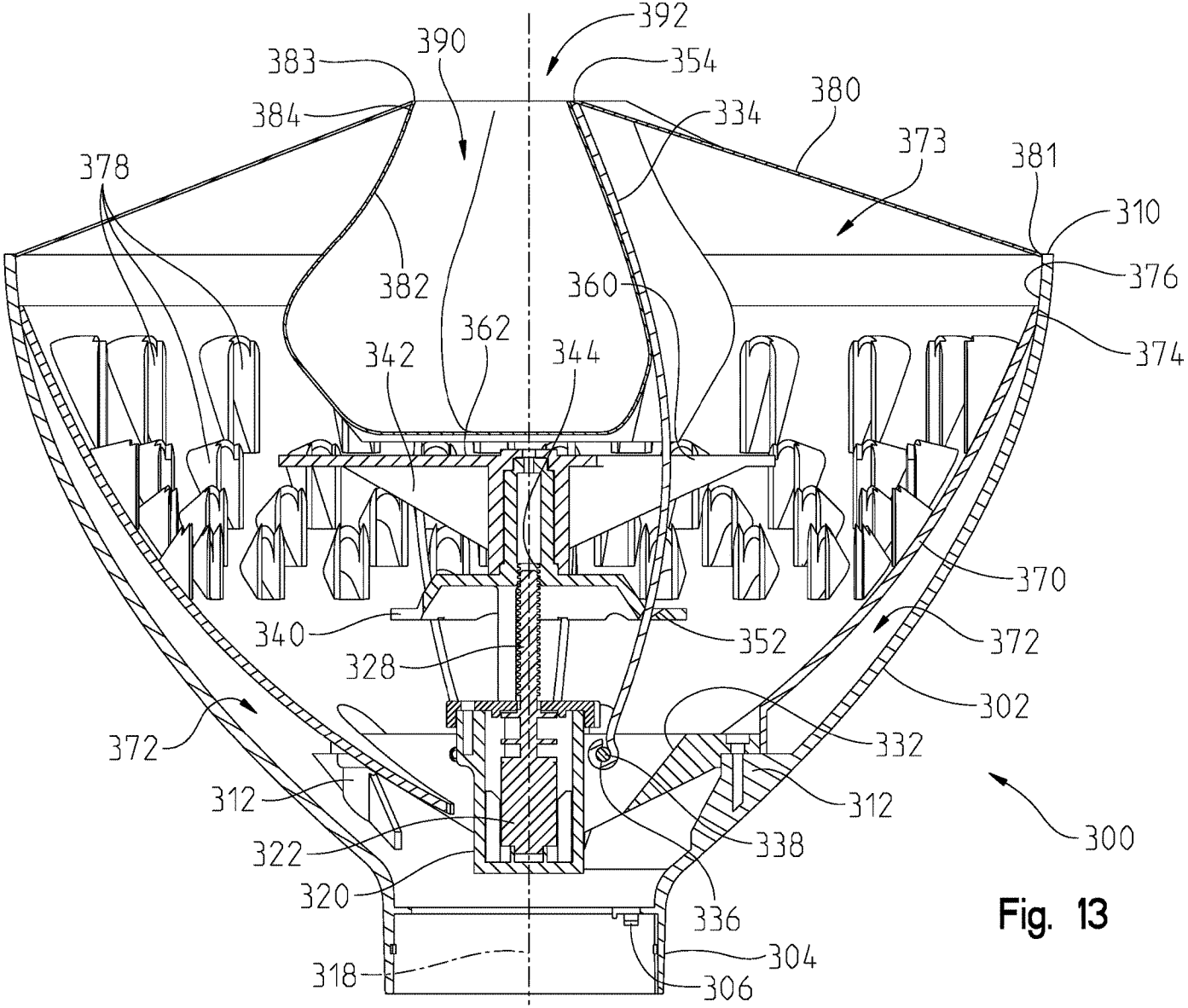
FIG. 13 is a side section view 15-15 of the diffuser in FIG. 17.
Figure 14:
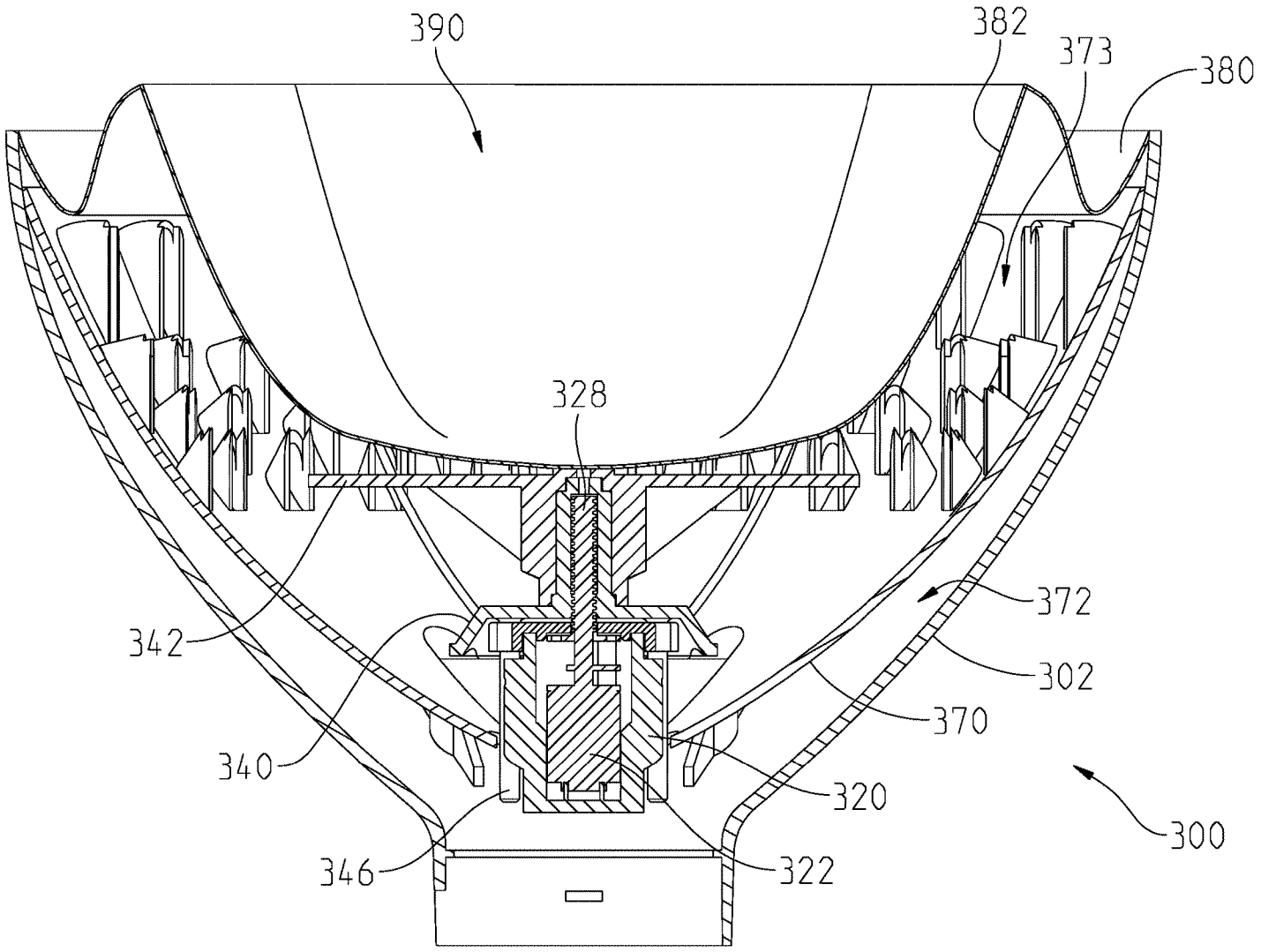
FIG. 14 is a side section view 14-14 of the diffuser in FIG. 17.
Figure 15:
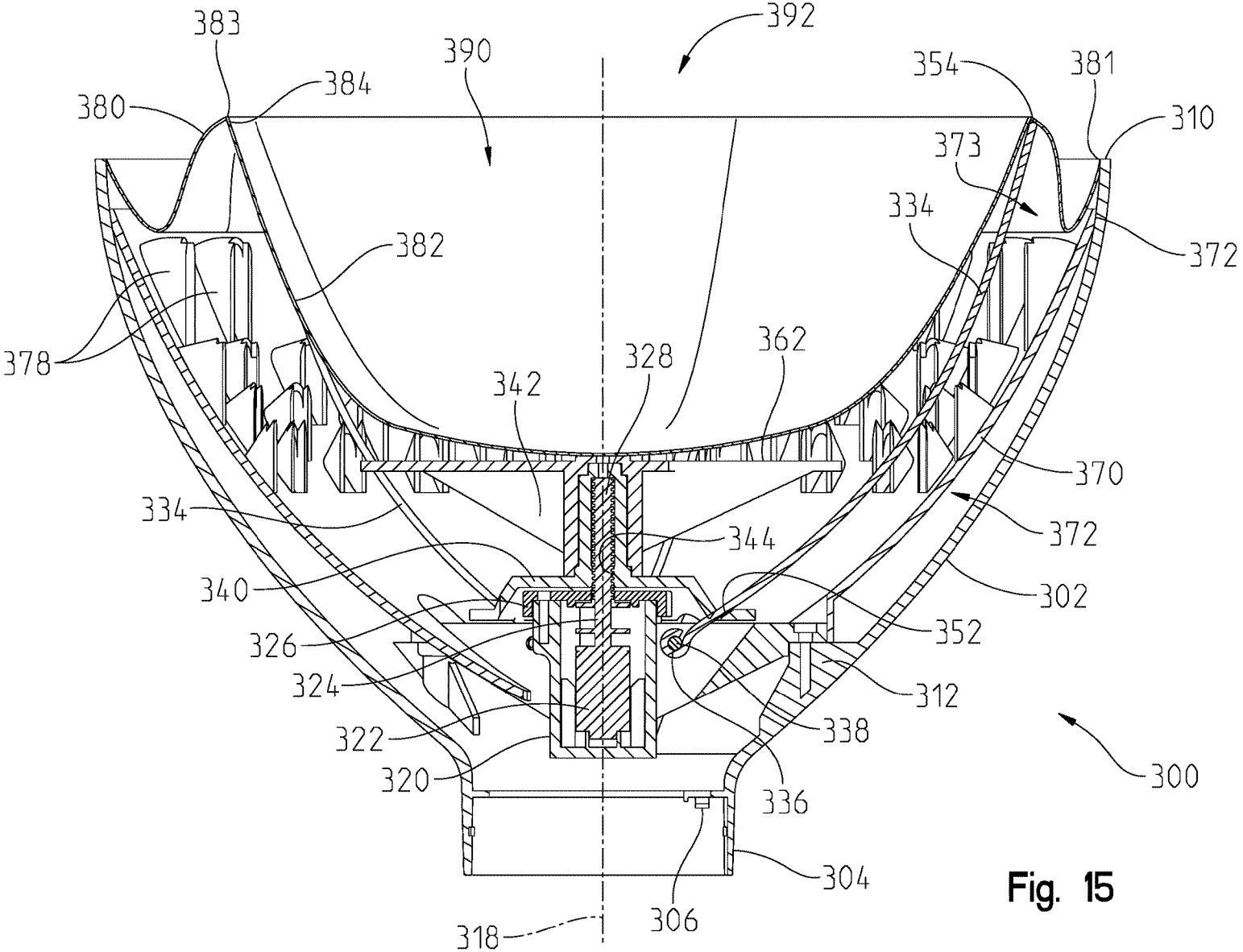
FIG. 15 is a side section view 15-15 of the diffuser in FIG. 17.
Figure 16:
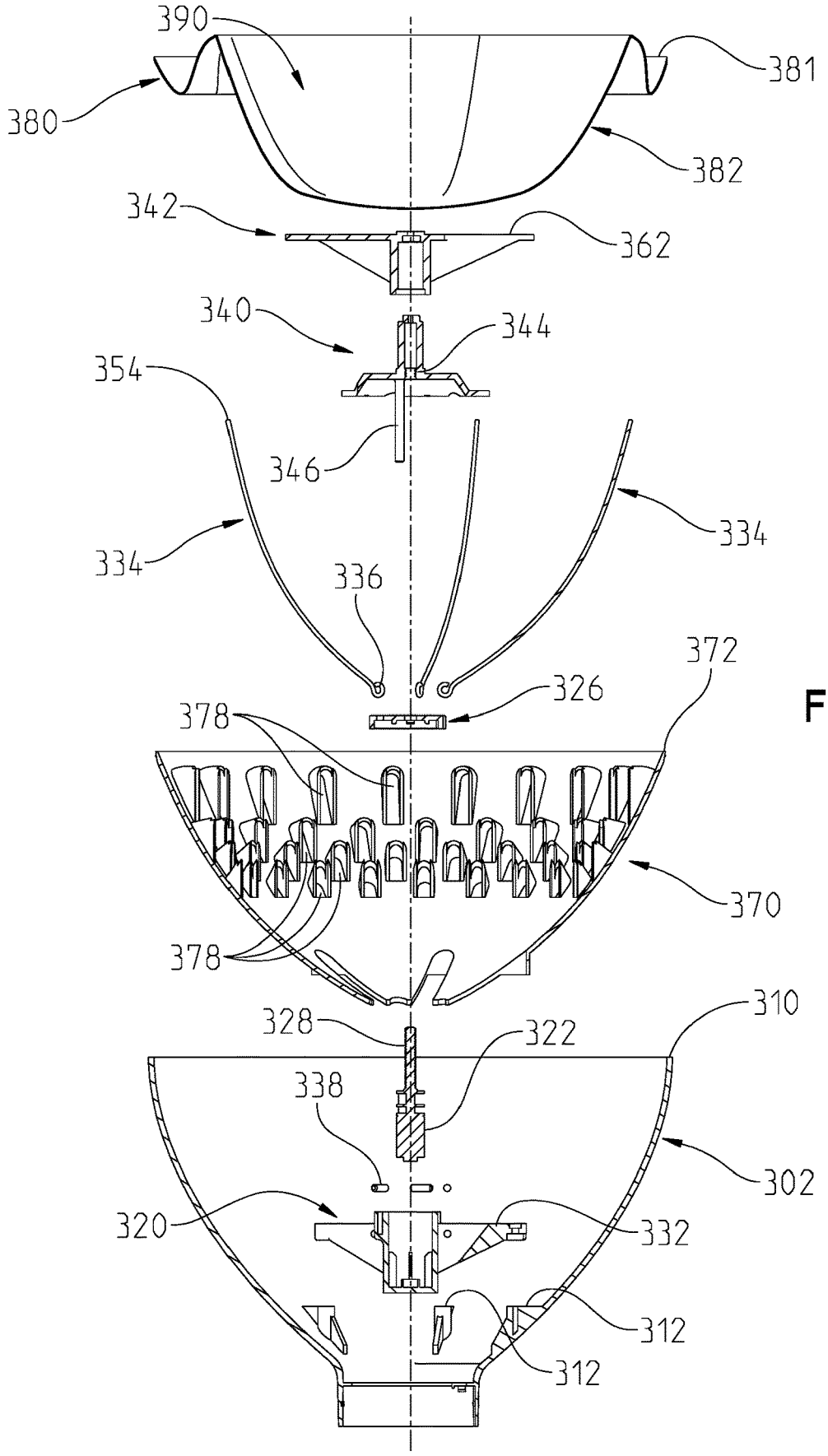
FIG. 16 is an exploded side view of the diffuser in FIG. 15.

The curling diffuser 300 has an outer cover 302 that has a connection sleeve portion 304. The connection sleeve portion 304 has an electrical connector 306 that mates with the accessory connector 28 on the hairdryer 10. The connection sleeve portion 304 includes a notch 308 that prevents the curling diffuser 300 from being improperly connected to the hairdryer 10. Proper connection allows the accessory connector 28 and electrical connector 306 to properly mate and make an electrical connection. The outer cover 302 is shown as parabolic, but conical, curved, semi-spherical, or other shape is contemplated. The outer cover 302 has an outer rim 310 where the diameter is at its largest. The outer cover 302 has mounting bosses 312 that allow other components of the diffuser to be affixed. One of the other components is a base 320. The base 320 is centered about the central axis 318 and houses a motor 322 and gearbox 324. The base 320, as shown, includes five finger holders 332, but it is contemplated that it includes a different number of finger holders 332. Each finger holder 332 has a wire finger 334 that is held at a pivot aperture 336. Pins 338 extend through the pivot apertures 336 to allow each wire finger 334 to pivot. A gearbox cover 326 keeps contaminants out of the gearbox 324 and allows a worm shaft 328 to extend therethrough. The gearbox cover 326 has guide apertures 330 and is affixed to the base 320 through fasteners. Mated to the worm shaft 328 is an inner slider 340. An outer slider 342 is connected to the inner slider 340. The inner slider 340 has a threaded portion 344 that causes the inner slider 340 to move along the central axis 318 when the worm shaft 328 rotates. The inner slider 340 can move between a retracted position (as shown in FIGS. 14-15) and an extended position (shown in FIGS. 12-13). The retracted position of the sliders 340, 342 corresponds to a resting position and the extended position of the sliders 340, 342 corresponds to a grasping position. Guide pins 346 extend through the guide apertures 330 of the gearbox cover 326 to prevent any rotation of the inner slider 340 as the worm shaft 328 rotates. As the sliders 340, 342 move between the extended and retracted positions, the guide pins 346 remain in the guide apertures 330. The inner slider 340 has finger guides 350 that correspond to each wire finger 334. The finger guides 350 each have a corresponding finger aperture 352 that constrain the finger 334. The pins 338 are located closer to the central axis 318 than the finger apertures 352 on the finger guides 350. The wire fingers 334, as shown, are curved with the pivot aperture 336 on one end, and an oppositely located terminal end 354.

The outer slider 342, also known as an upwards scrunching platform, moves axially with the inner slider 340 when the worm shaft 328 rotates. The outer slider 342 has a large flat surface with slits 360 that interrupt the outer surface 362. The slits 360 provide clearance and guidance to the wire fingers 334 when the sliders 340, 342 move outward and away from the base 320. The outer surface 362 is shown as planar, but other surface contours are contemplated, including but not limited to concave or convex. As shown in FIG. 13, the wire fingers 334 extend into the slits 360 in the grasping position.

An air redirection baffle 370 is attached to the base 320 and fits inside the outer cover 302 to form an air inlet chamber 372. The air inlet chamber 372 is defined by the air that is located between the connection sleeve portion 304, the outer cover 302, and the redirection baffle 370. The redirection baffle 370 has a terminal edge 374 that circumscribed by the outer cover 302. The terminal edge 374 fits inside the outer cover 302 and is seated inwardly below the outer rim 310. The terminal edge 374 is close, in contact, or in biased contact with the inner surface 376 of the outer cover 302. The proximity of the terminal edge 374 to the inner surface 376 allows air moving through the inlet chamber 372 to be directed to the directional apertures 378. The directional apertures 378, as shown, are bonneted dormer shaped, with a curved top, straight sides and a straight bottom. It is contemplated that the directional apertures 378 have other shapes not shown herein, such as triangular, oval, rectangular, circular, or other shape. The directional apertures 378 have overhanging walls that extend from the redirection baffle 370 towards the central axis 318. The overhanging walls serve to direct the air moving through the apertures 378 towards the center. Once the air has passed through the apertures 378, it enters a diffused chamber 373. As air from the hairdryer 10 enters the curling diffuser 300 through the connection sleeve portion 304, it is diverted by the redirection baffle 370 and through the directional apertures 378. Because the directional apertures 378 are facing the central axis 318, moving air that enters the diffused chamber 373 moves towards the center and outwardly.

The curling diffuser 300 includes a blocking membrane 380 that is connected to the outer rim 310 at an outer perimeter edge 381. The blocking membrane 380 is shown as an annular component. An inner perimeter edge 383 is connected to the fingers 334 at their terminal ends 354. The blocking membrane 380 is flexible and does not allow airflow through it. The blocking membrane 380 is shown as resilient and stretchable. It is contemplated that the blocking membrane is pleated or accordion bellows material that allows movement without requiring the material itself to be stretchable. While it is preferable that the blocking membrane 380 blocks the flow of air through its thickness, it may or may not be completely impermeable. It is contemplated that the blocking membrane 380 blocks a significant portion but not all air attempting to flow through it. The purpose of the blocking membrane 380 is to direct airflow through mesh 382. The mesh 382 is a screen that is flexible but allows air flow through its thickness. The mesh 382 is connected around its perimeter edge 384 to the blocking membrane 380 on its inner perimeter edge 383. It is contemplated that the mesh 382 is connected to the outer slider 342 to keep the mesh 382 from being pushed out when air is being pushed through the curling diffuser 300. The mesh 382 keeps hairs, fingers, or other foreign objects from becoming tangled up or ensnared in the moving parts of the diffuser 300. The diffused chamber 373 is defined by the chamber that is located between the redirection baffle 370, the blocking membrane 380, and mesh 382.

Figure 12:
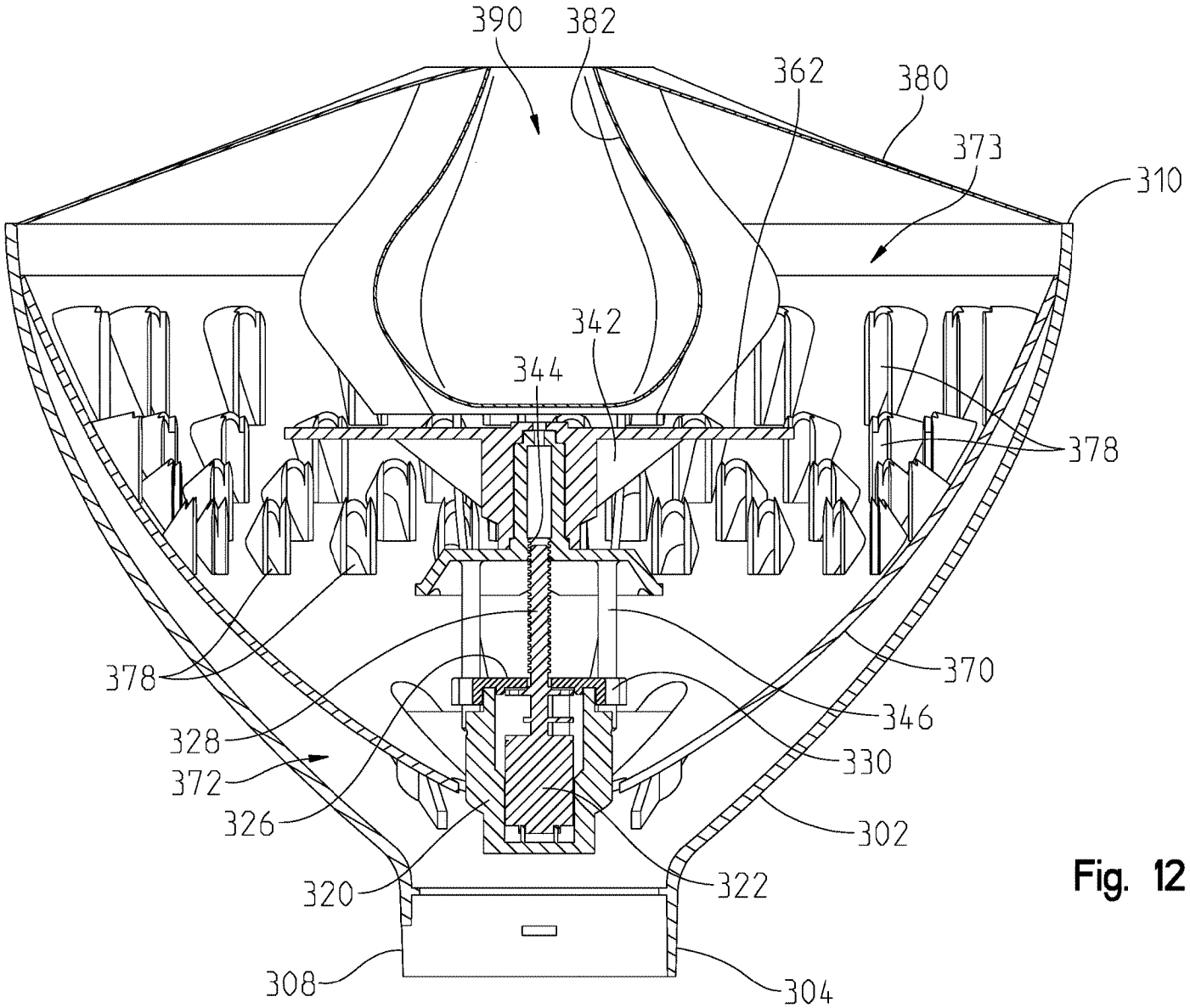
FIG. 12 is a side section view 14-14 of the diffuser in FIG. 17.
Figure 17:
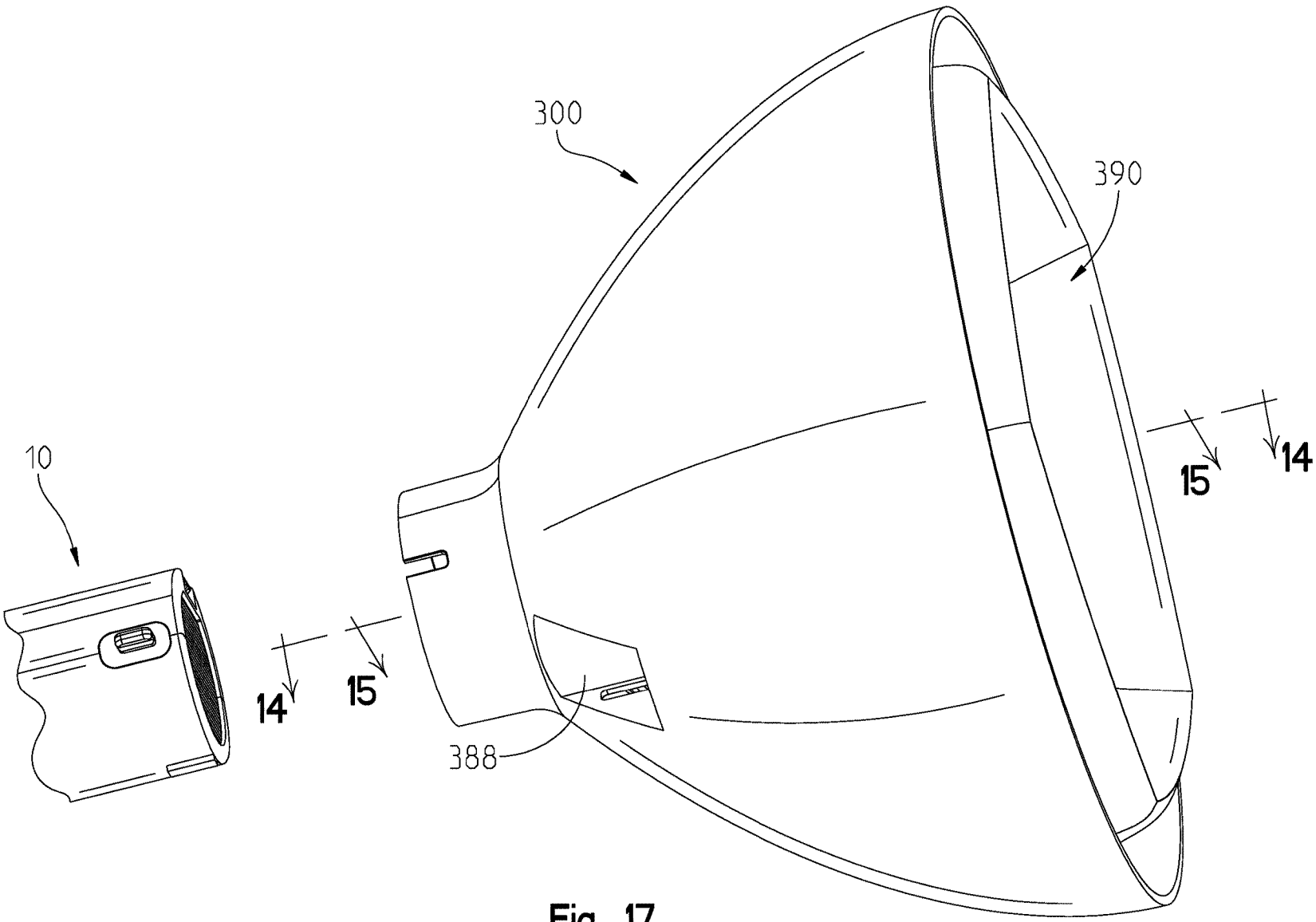
FIG. 17 is an isometric view of the diffuser being attached to the hairdryer in FIG. 1.
Figure 18:
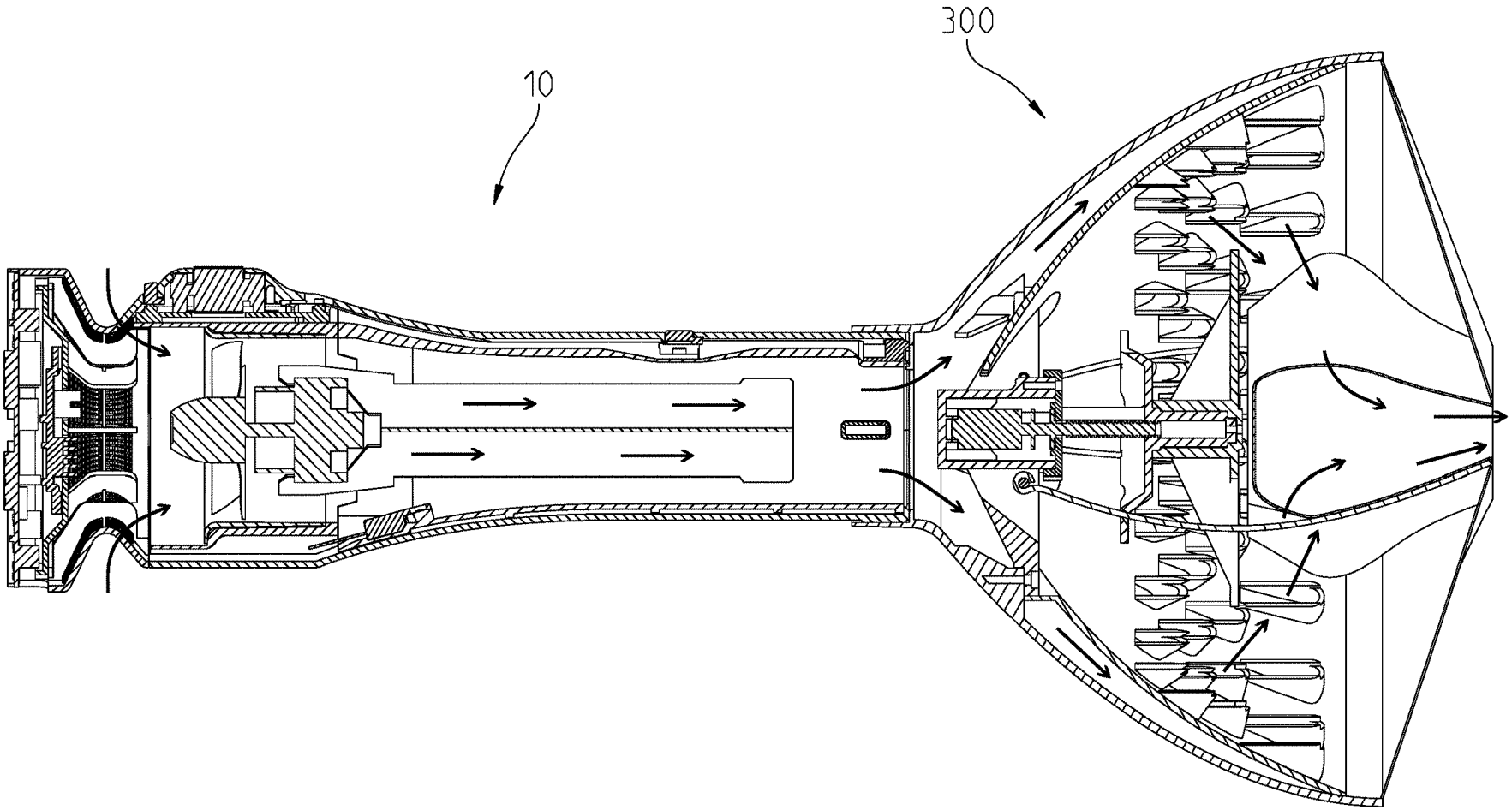
FIG. 18 is a side section view 15-15 of the diffuser as attached to the hairdryer as shown in FIG. 4.
Figure 19:
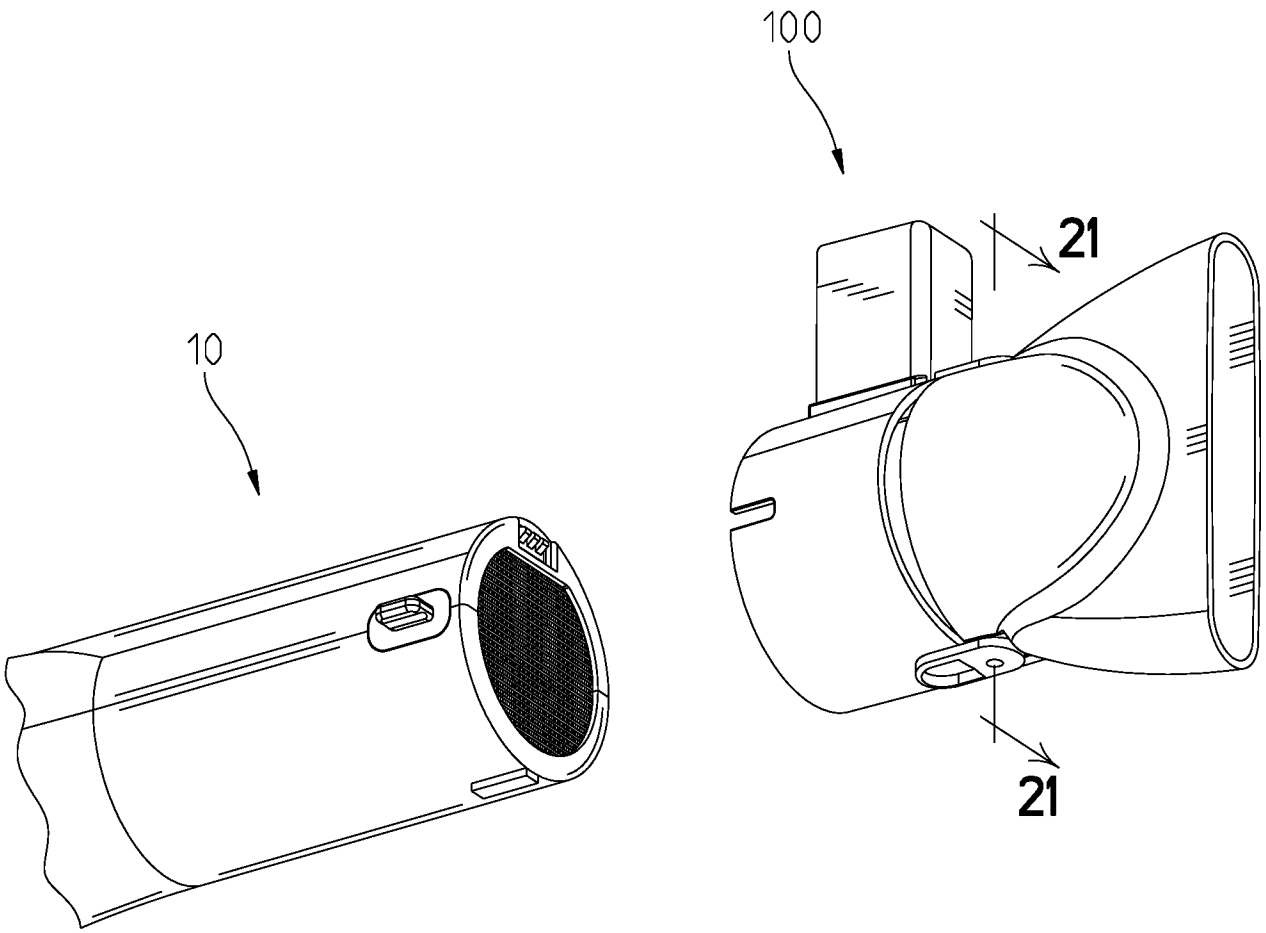
FIG. 19 is an isometric view of an oscillating nozzle as being attached to the hairdryer in FIG. 1.

When the user actuates the curling diffuser 300, the motor 322 rotates the gearbox 324, which causes the worm shaft 328 to rotate. This causes the inner and outer sliders 340, 342 to move away from the gearbox cover 326 along the central axis 318. The guide pins 346 slide through the guide apertures 330 while the pivot apertures 336 constrain movement along the central axis 318. As the inner slider 340 moves, the finger apertures 352 on the inner slider 340 draw the wire fingers 334 closer to the central axis 318. Because the wire fingers 334 are curved, their terminal ends 354 are brought closest together when the inner and outer slider 340, 342 are at the extended position. The extended position of the inner and outer sliders 340, 342 correspond to a grasping position of the curling diffuser 300 and the retracted position of the sliders 340, 342 correspond to an open position of the curling diffuser 300. The mesh forms a pocket 390 that can receive hair in the resting position that closes down significantly in the grasping position. The pocket 390 is defined by the volume between the mesh 382 and an outlet aperture 392 that is defined by the opening formed by the inner perimeter edge 383. The outlet aperture 392 moves between a relatively large size as shown in FIGS. 14, 15, and 17 when the diffuser 300 is in the resting position and a relatively small size as shown in FIGS. 12, 13, and 18 when the diffuser 300 is in the grasping position.

The inner slider 340 has a flag 386 that is adjacent a sensor 388 that is located in the outer cover 302 or redirection baffle 370. The flag 386 moves with the inner slider 340. The sensor 388 provides feedback to the motor 322 or hair dryer 10 of the slider position. Feedback of the position of the sliders 340, 342 allows the hair dryer 10 to properly drive the motor 322 to prevent damage to the gearbox 324, motor 322, wire fingers 344, or other components. It also allows the user to simply press the action button 70 to move the curling diffuser 300 between the relaxed and grasped position without having to worry about overdriving or damaging the mechanism.

In the open position, the user places a portion of hair in the pocket 390. The hairdryer 10 is turned on to move air through the diffuser 300, and then the user activates the action button 70. The action button 70 moves the diffuser 300 between the resting position and the grasping position.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A hair styling device comprising:

a main body centered about a central axis, said main body having an outlet portion on one end for receiving a removable powered accessory, said main body having a control portion on an end opposite said outlet portion, an inlet portion located between said control portion and said outlet portion, said inlet portion having a plurality of apertures spaced from and circumscribing said central axis, said main body having a brushless motor for moving air from said inlet portion to said outlet portion and a resistive heater for heating said air from said brushless motor, said outlet portion having an accessory connector for supplying power to said removable powered accessory controlled by said control portion, a portion of said apertures facing said control portion;

a DC power supply spaced from said main body and a multi-conductor cord extending between said DC power supply and said main body, an AC power connector electrically connected to said DC power supply and said multi-conductor cord, said multi-conductor cord for supplying DC power from said DC power supply and AC power from said AC power connector to said control portion; and said removable powered accessory connectable to said outlet portion, said removable powered accessory having an electrical connector connected to said accessory connector when said removable powered accessory is connected to said outlet portion, said removable powered accessory having an accessory motor.

2. The hair styling device of claim 1, said removable powered accessory being a curling diffuser having an outer shell for releasably connecting to said outlet portion and said accessory connector, said curling diffuser having a redirection baffle having a plurality of directional apertures extending therethrough, said redirection baffle fixed with respect to said outer shell, said curling diffuser having a plurality of fingers each constrained on one end by a corresponding pivot, each said finger having a terminal end located oppositely said corresponding pivot, said curling diffuser having a slider movable with respect to said outer shell along said central axis between a retracted position and an extended position by said accessory motor connected to said electrical connector, said slider having a plurality of finger apertures, each said finger extending through and constrained by a corresponding said finger aperture, said curling diffuser having an annular blocking membrane sealed with respect to said curling diffuser, said annular blocking membrane having an outlet aperture, each said terminal end of said fingers attached to said blocking membrane, when said slider is in said retracted position, said terminal ends of said fingers located at a relatively far distance from said central axis, when said slider is in said extended position, said terminal ends of each said fingers located at a relatively close distance to said central axis.

3. The hair styling device of claim 2, wherein said accessory motor has a threaded worm shaft received by said slider, rotation of said threaded worm shaft moves said slider along said central axis, said slider is fixed from rotation with respect to said outer shell.

4. The hairstyling device of claim 2, wherein moving said slider nearer said pivots of said fingers changes the angle between pivot of said finger and said corresponding finger aperture in said slider.

5. A hair styling device comprising:

a main body having an elongate outer shell centered about a central axis, an outlet portion of said outer shell circumscribing an inner shell having a resistive heater, a center portion of said outer shell surrounding a brushless motor, said brushless motor having a fixed portion fixed with respect to said main body and a rotating portion rotatable with respect to said fixed portion about said central axis and having an impeller rotatable therewith, said main body having an inlet portion having annular inlet apertures extending therethrough, said annular inlet apertures spaced from and circumscribing said central axis, said center portion located between said outlet portion and said inlet portion, said inlet portion located between said center portion and a control portion, a duct plate forming a boundary between said control portion and said inlet portion, said central axis extending from said control portion through said outlet portion;

an AC power connector electrically connected to a DC power supply having a DC output, said DC power supply separate and external to said main body, said AC power connector and said DC output electrically connected to a control circuit in said control portion through a multi-conductor cord extending between said DC power supply and said main body, said multi-conductor cord supplying AC and DC power to said control circuit when said power connector is connected to an external AC power source;

an accessory connector fixed with respect to said outlet portion, said accessory connector for supplying power to an external accessory; and said control circuit in electrical communication with a display, a control panel, said brushless motor, and said resistive heater, said control circuit for supplying said DC power to said brushless motor and said AC power to said resistive heater.

6. The hair styling device of claim 5, wherein said external accessory being a removable curling diffuser, said removable curling diffuser having a connection sleeve portion for attaching said removable curling diffuser to said outlet portion of said main body, said removable curling diffuser having a plurality of fingers movable between a grasped and relaxed position, said removable curling diffuser having an integral electrical connector that mates with said accessory connector for conducting electricity to an accessory motor in said removable curling diffuser when said removable curling diffuser is attached to said main body.

7. The hair styling device of claim 5, further comprising a removable scent pod held to said main body, said central axis intersecting said scent pod when said scent pod is held to said main body.

8. The hair styling device of claim 5, wherein said inlet portion is hourglass shaped, a portion of said annular inlet apertures face said duct plate and a portion of said annular inlet apertures face said center portion.

9. The hair styling device of claim 5, wherein said brushless motor is circumscribed by and held to said main body by a resilient dampener.

10. The hair styling device of claim 5, further comprising an attachable curling diffuser having an outer shell for releasably connecting to said outlet portion and said accessory connector, said attachable curling diffuser having a redirection baffle having a plurality of directional apertures extending therethrough, said redirection baffle fixed with respect to said outer shell, said attachable curling diffuser having a plurality of fingers each constrained on one end by a corresponding pivot, each said finger having a terminal end located oppositely said corresponding pivot, said attachable curling diffuser having a slider movable with respect to said outer shell along said central axis between a retracted position and an extended position, said slider having a plurality of finger apertures, each said finger extending through and constrained by a corresponding said finger aperture, said attachable curling diffuser having an annular blocking membrane sealed with respect to said attachable curling diffuser, said annular blocking membrane having an outlet aperture, each said terminal end of said fingers attached to said blocking membrane, when said slider is in said retracted position, said terminal ends of said fingers located at a relatively far distance from said central axis, when said slider is in said extended position, said terminal ends of each said fingers located at a relatively close distance to said central axis.

11. A hair styling powered diffuser for use with a hairdryer having an accessory connector and an action button, said diffuser comprising:

an outer shell having a connection sleeve portion, said connection sleeve portion for releasably connecting to a hairdryer outlet and said accessory connector;

a redirection baffle having a plurality of directional apertures extending therethrough, said redirection baffle fixed with respect to said outer shell;

a plurality of fingers each constrained on one end by a corresponding pivot, each said finger having a terminal end located oppositely said corresponding pivot;

a slider movable with respect to said outer shell by an accessory motor along a central axis between a retracted position and an extended position, each said finger constrained by said slider;

an annular blocking membrane having an outer perimeter edge and an inner perimeter edge, said outer perimeter edge sealed with respect to said outer shell, said inner perimeter edge attached to a mesh, each said terminal end of said fingers attached to said blocking membrane; and said slider cooperating with said fingers to move said terminal ends of said fingers closer to said central axis when said slider moves toward said extended position.

12. The hair styling powered diffuser in claim 11, wherein said slider has an outer surface intersected by said central axis.

13. The hair styling powered diffuser in claim 1, wherein said accessory motor has a threaded worm shaft, said threaded worm shaft threadably received by said slider, rotation of said threaded worm shaft moves said slider between said retracted and said extended position.

14. The hair styling powered diffuser in claim 11, wherein said outer shell and said redirection baffle forming an inlet chamber, said blocking membrane and said redirection baffle forming a diffused chamber, said inner perimeter edge of said blocking membrane forming an outlet aperture, said mesh forming a pocket for holding hair, said outlet aperture constricting when said slider is in said extended position.

15. The hair styling powered diffuser in claim 11, further comprising a sensor detecting said position of said slider, said sensor in electrical communication with said accessory connector.

16. The hair styling powered diffuser in claim 11, further comprising a hair styling device having a main body having an elongate outer shell centered about said central axis, an outlet portion of said outer shell circumscribing an inner shell having a resistive heater, a center portion of said outer shell surrounding a brushless motor, said brushless motor having a fixed portion fixed with respect to said main body and a rotating portion rotatable with respect to said fixed portion about said central axis and having an impeller rotatable therewith, said main body having an inlet portion having inlet apertures located around a periphery, said center portion located between said outlet portion and said inlet portion, said inlet portion located between said center portion and a control portion, a duct plate forming a boundary between said control portion and said inlet portion, said central axis extending from said control portion through said outlet portion, an AC power connector electrically connected to a DC power supply having a DC output, said DC power supply separate from said main body, said AC power connector and said DC output electrically connected to a control circuit in said control portion through a multi-conductor cord extending between said DC power supply and said main body, said multi-conductor cord supplying AC and DC power to said control circuit when said power connector is connected to an external AC power source, an accessory connector fixed with respect to said outlet portion, said accessory connector for supplying power to an external accessory, and said control circuit in electrical communication with a display, a control panel, said brushless motor, and said resistive heater.

17. The hair styling powered diffuser in claim 11, said slider having a plurality of finger apertures, each said finger extending through a corresponding said finger aperture.

* * * * *